US010512332B2

(12) United States Patent
LaPointe et al.

(10) Patent No.: US 10,512,332 B2
(45) Date of Patent: Dec. 24, 2019

(54) RECLINER AND LEGREST MECHANISM FOR A FURNITURE MEMBER

(71) Applicant: La-Z-Boy Incorporated, Monroe, MI (US)

(72) Inventors: Larry P. LaPointe, Temperance, MI (US); Chad E. Adams, Perrysburg, OH (US); Jason Rains, Evensville, TN (US); Jason Bryson, Athens, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 15/815,301

(22) Filed: Nov. 16, 2017

(65) Prior Publication Data

US 2018/0070725 A1 Mar. 15, 2018

Related U.S. Application Data

(63) Continuation of application No. 14/798,867, filed on Jul. 14, 2015, now Pat. No. 10,092,106.

(51) Int. Cl.
*A47C 1/035* (2006.01)
*A47C 1/0355* (2013.01)

(52) U.S. Cl.
CPC ..... *A47C 1/0355* (2013.01); *A47C 1/0352* (2013.01)

(58) Field of Classification Search
CPC ..... A47C 1/0352; A47C 1/035; A47C 1/0355; A47C 1/032; A47C 1/03294; A47C 1/024
See application file for complete search history.

(56) References Cited

U.S. PATENT DOCUMENTS 203,602 A 5/1878 Dietsch
2,473,895 A 6/1949 Mednick
(Continued)

FOREIGN PATENT DOCUMENTS

CN 200976974 Y 11/2007
DE 623960 C 1/1936
(Continued)

OTHER PUBLICATIONS

International Search Report and Written Opinion of the International Searching Authority for Application No. PCT/US2016/021361, dated May 30, 2016.
(Continued)

*Primary Examiner* — Timothy J Brindley
(74) *Attorney, Agent, or Firm* — Harness, Dickey & Pierce, P.L.C.

(57) ABSTRACT

A furniture member may include a stationary base frame, a seat bottom frame, a seat bottom cushion, a seatback frame, and a seatback cushion. The base frame may include a forward support, an aft support, and a pair of armrests that extend between the forward support and the aft support. The forward, aft and lateral supports are stationary and fixed relative to each other. The seat bottom frame may be supported by the base frame. An upper end of the seatback frame may be pivotably coupled to the aft support such that the seatback frame is rotatable relative to the aft support and the seat bottom frame between a first position and a second position. A lower end of the seatback cushion has a greater range of motion than an upper end of the seatback cushion when the seatback frame moves between the first and second positions.

27 Claims, 22 Drawing Sheets

(56) References Cited

U.S. PATENT DOCUMENTS 2,719,572 A 10/1955 Goldberg
2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,352,601 A 11/1967 Cycowicz
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
4,099,776 A 7/1978 Crum
4,140,342 A 2/1979 Jones
4,179,157 A 12/1979 Shoemaker et al.
4,212,494 A 7/1980 Dabney
4,216,991 A 8/1980 Holobaugh
4,216,992 A 8/1980 Crum
4,226,468 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,996 A 2/1986 Rogers, Jr.
4,582,435 A 4/1986 Davis
4,601,513 A 7/1986 Pine
4,650,211 A 3/1987 Tanahashi
4,662,597 A 5/1987 Uecker et al.
4,740,031 A 4/1988 Rogers, Jr.
4,805,960 A 2/1989 Tacker
4,861,101 A 8/1989 Hartline
4,932,927 A 6/1990 Fillar
4,989,914 A 2/1991 Pine
5,011,220 A 4/1991 LaPointe
5,064,244 A 11/1991 Sproule
5,072,988 A 12/1991 Plunk
5,088,789 A 2/1992 LaPointe et al.
5,123,705 A 6/1992 Johnson
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,234,253 A 8/1993 LaPointe et al.
5,238,295 A 8/1993 Harrell
5,328,235 A 7/1994 Saul et al.
5,360,255 A 11/1994 Cook et al.
5,423,591 A 6/1995 LaPointe et al.
5,435,621 A 7/1995 Komorowski et al.
5,435,622 A 7/1995 Fay et al.
5,480,209 A 1/1996 May
5,480,213 A * 1/1996 Sproule ..... A47C 1/0352 297/188.01
5,527,095 A 6/1996 Marshall et al.
5,567,009 A 10/1996 Fay et al.
5,570,927 A 11/1996 LaPointe et al.
5,570,930 A 11/1996 LaPointe et al.
5,597,209 A 1/1997 Bart et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,857,739 A 1/1999 Smith
5,865,457 A 2/1999 Knabusch et al.
5,954,392 A 9/1999 Liss et al.
5,971,475 A 10/1999 Lawson
5,975,627 A 11/1999 LaPointe et al.
6,000,754 A 12/1999 Lawson
6,179,328 B1 1/2001 Kawagoe et al.
6,309,015 B1 10/2001 Pine
6,330,995 B1 12/2001 Mangeiga et al.
6,467,845 B1 10/2002 Chen
6,488,332 B1 12/2002 Markwald
6,491,342 B1 * 12/2002 Smith ..... A47C 1/0352 297/68
6,827,401 B2 12/2004 Marshall et al.
6,939,076 B2 9/2005 LaPointe
7,261,367 B2 8/2007 Duncan et al.
7,275,789 B2 10/2007 LaPointe
7,357,450 B2 4/2008 Rogers
7,475,944 B2 1/2009 Griepentrog et al.
7,637,571 B2 12/2009 Okano et al.
7,673,933 B2 3/2010 Lawson
7,731,276 B2 6/2010 Hoffman et al.
7,828,380 B2 11/2010 Olarte
7,850,232 B2 12/2010 Casteel
8,132,855 B2 3/2012 Richard
8,308,228 B2 11/2012 Lawson et al.
8,573,687 B2 11/2013 Lawson et al.
8,590,964 B2 11/2013 Murphy et al.
8,616,627 B2 12/2013 Murphy et al.
8,622,467 B2 1/2014 Murphy et al.
9,314,101 B2 4/2016 Harwood et al.
9,357,847 B2 6/2016 Murphy
9,433,295 B2 9/2016 Crum
9,635,943 B2 5/2017 Lawson
9,655,450 B2 5/2017 Marshall et al.
9,655,451 B2 5/2017 Harwood et al.
9,808,090 B2 11/2017 Carrera
9,986,832 B2 6/2018 LaPointe et al.
9,986,835 B2 6/2018 LaPointe et al.
10,092,106 B2 10/2018 LaPointe et al.
2003/0057743 A1 3/2003 May
2004/0000803 A1 1/2004 Guillot et al.
2005/0067867 A1 3/2005 May
2006/0061147 A1 3/2006 Johnson
2006/0103202 A1 5/2006 Maki et al.
2006/0249992 A1 11/2006 LaPointe et al.
2006/0249993 A1 11/2006 Rogers
2007/0040419 A1 2/2007 LaPointe et al.
2007/0085395 A1 4/2007 LaPointe
2007/0241589 A1 10/2007 LaPointe
2008/0150329 A1 6/2008 Lawson
2009/0284054 A1 11/2009 Humer et al.
2011/0175426 A1 7/2011 Lawson
2011/0233972 A1 9/2011 Weicek
2011/0248544 A1 10/2011 Adams et al.
2011/0248547 A1 10/2011 LaPointe et al.
2011/0304193 A1 12/2011 Murphy et al.
2012/0193946 A1 8/2012 Robertson
2013/0062914 A1 3/2013 Marshall et al.
2013/0140855 A1 6/2013 Murphy et al.
2013/0175847 A1 7/2013 Lawson
2014/0049079 A1 2/2014 Lawson et al.
2014/0049084 A1 2/2014 Lawson et al.
2014/0070585 A1 3/2014 LaPointe
2014/0103688 A1 4/2014 Wilson
2014/0312660 A1 10/2014 Natuzzi et al.
2014/0333099 A1 11/2014 Lu et al.
2015/0196123 A1 7/2015 Buehrer
2015/0250320 A1 9/2015 Arceci et al.
2015/0272329 A1 10/2015 Lawson
2015/0282619 A1 10/2015 Lawson
2016/0058195 A1 3/2016 Huang et al.
2016/0100687 A1 4/2016 Murphy
2016/0302573 A1 * 10/2016 Garland ..... A47C 1/036
2016/0376007 A1 12/2016 Meindlhumer
2017/0013961 A1 1/2017 LaPointe et al.
2017/0042330 A1 2/2017 Bruce et al.
2017/0101188 A1 4/2017 Auge et al.
2017/0150818 A1 6/2017 Contreras
2017/0367483 A1 12/2017 Fecker et al.
2018/0078039 A1 3/2018 LaPointe et al.
2018/0289156 A1 * 10/2018 Marshall ..... A47C 1/0352

(56) References Cited

U.S. PATENT DOCUMENTS

| | | | | |
|---|---|---|---|---|
| 2018/0289157 | A1 | 10/2018 | Marshall et al. | |
| 2018/0289158 | A1* | 10/2018 | Marshall | A47C 1/0355 |
| 2019/0116981 | A1 | 4/2019 | LaPointe et al. | |

FOREIGN PATENT DOCUMENTS

| | | | |
|---|---|---|---|
| EP | 1504697 | A1 | 2/2005 |
| JP | 2001054443 | A | 2/2001 |
| JP | 2003070583 | A | 3/2003 |
| KR | 1020060036132 | | 4/2006 |
| KR | 100807370 | B1 | 2/2008 |
| KR | 101245357 | B1 | 3/2013 |
| WO | WO-9611612 | A1 | 4/1996 |
| WO | WO-2011094478 | A1 | 8/2011 |
| WO | WO-2012162499 | A1 | 11/2012 |
| WO | WO-2015066030 | A1 | 5/2015 |

OTHER PUBLICATIONS

International Search Report and Written Opinion of the International Searching Authority for Application No. PCT/US2017/035976, dated Aug. 25, 2017.
U.S. Appl. No. 14/798,867, filed Jul. 14, 2015.
U.S. Appl. No. 14/798,867, filed Jul. 14, 2015, Larry P. LaPointe et al.
U.S. Appl. No. 15/481,642, filed Apr. 7, 2017, Richard E. Marshall et al.
U.S. Appl. No. 15/815,363, filed Nov. 16, 2017, Richard E. Marshall et al.
U.S. Appl. No. 15/831,865, filed Dec. 5, 2017, Richard E. Marshall et al.
International Search Report and Written Opinion of the International Searching Authority for Application No. PCT/US2018/025467, dated Jul. 17, 2018.
International Search Report for EP Application No. 18159817.8 dated Sep. 26, 2018.
International Search Report for Application No. PCT/US2019/021568, dated Jun. 20, 2019.
Written Opinion of the International Searching Authority for Application No. PCT/US2019/021568, dated Jun. 20, 2019.
First Examination Report for New Zealand Application No. 738919, dated Mar. 14, 2019.
European Search Report for Application No. 19158581.9, dated May 3, 2019.
International Search Report for Application No. PCT/US2006/031852, dated Jun. 17, 2008.
Written Opinion of the International Searching Authority for Application No. PCT/US2006/031852, dated Jun. 17, 2008.
International Search Report for Application No. PCT/US2014/019455, dated May 26, 2014.
Written Opinion of the International Searching Authority for Application No. PCT/US2014/019455, dated May 26, 2014.
International Search Report for Application No. PCT/US2017/043899, dated Nov. 8, 2017.
Written Opinion of the International Searching Authority for Application No. PCT/US2017/043899, dated Nov. 8, 2017.
European Search Report for Application No. 16824840.9, dated Dec. 7, 2018.
U.S. Appl. No. 16/414,157, filed May 16, 2019, Larry P. LaPointe et al.
International Search Report for Application No. PCT/US2016/032967 dated Aug. 19, 2016.
Written Opinion of the International Searching Authority for Application No. PCT/US2016/032967 dated Aug. 19, 2016.

* cited by examiner

RECLINER AND LEGREST MECHANISM FOR A FURNITURE MEMBER

CROSS-REFERENCE TO RELATED APPLICATIONS

This application is a continuation of U.S. patent application Ser. No. 14/798,867 filed on Jul. 14, 2015. The entire disclosure of the above application is incorporated herein by reference.

FIELD

The present disclosure relates to a recliner and legrest mechanism for a furniture member.

BACKGROUND

This section provides background information related to the present disclosure and is not necessarily prior art.

Furniture members (e.g., chairs, sofas, loveseats, etc.) can include a legrest that can be extended and retracted and a seatback that can be reclined. Such functionality is often a tradeoff with aesthetic design. That is, the aesthetic design options of such conventional motion furniture members are often limited to accommodate mechanisms that enable deploying and stowing the legrest and moving the seatback and seat bottom. Conventional recliner and legrest mechanisms prohibit certain aesthetic design features and styles that are popular in modern stationary furniture members. The present disclosure provides furniture members that incorporate recliner and legrest mechanisms into an overall design that incorporates desirable aesthetic design features that are not feasible with conventional mechanisms.

SUMMARY

This section provides a general summary of the disclosure, and is not a comprehensive disclosure of its full scope or all of its features.

In one form, the present disclosure provides a furniture member that may include a stationary base frame, a seatback frame, a seat bottom frame and a linkage. The seatback frame may be supported by the base frame and may be pivotable relative to the base frame. The seat bottom frame may be supported by the base frame and may be movable relative to the seatback frame and the base frame. The linkage may be attached to the base frame, the seatback frame, the seat bottom frame and a legrest platform. The linkage may be movable between a first position and a second position. Movement of the linkage toward the first position may cause the seatback frame to move toward a fully upright position and may simultaneously cause the legrest platform to move toward a stowed position. Movement of the linkage toward the second position may cause the seatback frame to move toward a fully reclined position and simultaneously cause the legrest platform to move toward a fully extended position.

In some configurations, the seatback frame is pivotable relative to the base frame about an axis extending through an upper portion (e.g., at or near a vertically upper end) of the seatback frame.

In some configurations, the base frame hides the entire linkage from view when the linkage is in the first position.

In some configurations, the linkage is powered by a single motor movable in a first direction to move the seatback from the fully upright position to the fully reclined position while simultaneously moving the legrest platform from the stowed position to the fully extended position. The single motor may be movable in a second direction to move the seatback from the fully reclined position to the fully upright position while simultaneously moving the legrest platform from the fully extended position to the stowed position.

In some configurations, the motor moves a slide member linearly along a guide member. The slide member may be rotatably attached to the seat bottom frame, and the guide member may be rotatably attached to the base frame.

In some configurations, the linkage includes a track assembly including a first member and a second member that is translatable along a length of the first member. The second member may be rotatably coupled with a platform bracket supporting the legrest platform.

In some configurations, the linkage includes a throw arm that is coupled to the first member for rotation relative to the first member and translation with the first member relative to the second member.

In some configurations, the throw arm is rotatably coupled to an extension link that is rotatably coupled to the platform bracket.

In some configurations, the base frame includes a first roller that is received in a curved track of the first member.

In some configurations, the base frame includes a second roller that is received in another track fixedly attached to the seat bottom frame.

In some configurations, the throw arm is rotatably coupled to first, second and third links at three different locations along a length of the throw arm.

In some configurations, rotation of the throw arm determines timing of movement of the seatback frame, the seat bottom frame and the legrest platform relative to the base frame.

In some configurations, the base frame is configured for a single seat assembly.

In some configurations, the base frame is configured for a plurality of seat assemblies.

In some configurations, the linkage includes a first curved track and a second curved track. The first curved track may movably receive a first roller attached to the base frame and a second roller attached to the seat bottom frame. The second curved track may receive a third roller attached to the first curved track to allow for relative telescoping movement between the first and second curved tracks. The second curved track may rotatably support the legrest platform.

In some configurations, the seat bottom frame includes a third curved track member fixedly attached thereto. The third curved track member may receive a fourth roller attached to the base frame.

In some configurations, the second curved track is shaped to provide a downward dipping movement of the legrest platform during initial movement of the linkage from the first position to the second position. Furthermore, the second curved track may be shaped to subsequently extend and lift the legrest platform in response to continued movement of the linkage toward the second position.

In some configurations, the linkage includes a curved track member and a pantograph linkage. The curved track member may movably receive a first roller attached to the base frame and a second roller attached to the seat bottom frame. The pantograph linkage may be movably supported by the curved track member and may movably support the legrest platform.

In some configurations, movement of the curved track member relative to the base frame moves the legrest platform relative to the base frame.

In some configurations, movement of the pantograph linkage relative to the curved track member extends and lifts the legrest platform relative to the base frame.

In some configurations, the linkage is packaged within a space having a depth dimension of about 28 to 32 inches (e.g., 30 inches) when the linkage is in the fully stowed position and is configured to extend the legrest platform to about 18 to 20 inches (e.g., 19 inches) in front of the seat bottom frame in the fully extended position. The depth dimension extends parallel to a floor upon which the furniture member is situated between fore and aft ends of the furniture member.

In some configurations, the base frame includes legs that are about five to six inches (e.g., 5.5 inches) tall, and the linkage is disposed entirely above top ends of the legs in the fully stowed position.

In some configurations, a vertical distance between the floor and a top of the seat bottom frame is about 11 to 12 inches (e.g., 11.5 inches) in the fully stowed position.

In some configurations, the seat bottom frame travels forward relative to the base frame by about six to eight inches (e.g., 7 inches).

In some configurations, the seat bottom frame separates from the seatback frame as the linkage moves from the fully stowed position to the fully extended position.

In another form, the present disclosure provides a furniture member that may include a stationary base frame, first and second seatback frames, first and second seat bottom frames, and an upholstery system. The first and second seatback frames may be supported by the base frame and may be pivotable relative to each other and the base frame about an axis extending through upper portions of the first and second seatback frames. The first and second seatback frames are pivotable between upright and reclined positions. The first and second seat bottom frames may be supported by the base frame and may be movable relative to the first and second seatback frames and the base frame. The upholstery system may include a unitary seatback upholstery sheet covering the first and second seatback frames, a first seat bottom upholstery sheet covering the first seat bottom frame, and a second seat bottom upholstery sheet covering the second seat bottom frame. The seatback upholstery sheet including an upper portion, a first lower portion corresponding to the first seatback frame, and a second lower portion corresponding to the second seatback frame. The first and second lower portions may be independently movable relative to the upper portion.

In some configurations, the first and second lower portions of the seatback upholstery sheet are separated from the first and second seat bottom upholstery sheets when the first and second seatback frames are in the reclined position.

In some configurations, the first and second lower portions of the seatback upholstery sheet are in contact with the first and second seat bottom upholstery sheets, respectively, when the first and second seatback frames are in the upright position.

In another form, the present disclosure provides a furniture member may include a stationary base frame, a seat bottom frame, a seat bottom cushion, and a seatback cushion. The stationary base frame may include a forward support, an aft support, and a pair of armrests that extend between the forward support and the aft support. The forward, aft and lateral supports are stationary and fixed relative to each other. The aft support is disposed vertically higher than the forward support and the armrests. The seat bottom frame may be supported by the base frame. The seat bottom cushion may be supported by the seat bottom frame. The seatback cushion may be disposed adjacent the seat bottom cushion and movable relative to the aft support between a first position and a second position.

In some configurations, the seat bottom cushion is movable with the seat bottom frame relative to the base frame.

In some configurations, the furniture member includes a legrest mechanism coupled to the seat bottom frame and movable relative to the base frame between a retracted position and an extended position.

In some configurations, the seatback cushion moves between the first and second positions in response to movement of the seat bottom frame relative to the base frame.

In some configurations, the first position of the seatback cushion is an upright position and the second position of the seatback cushion is a reclined position. A lower portion of the seatback cushion may move forward relative to the base frame as the seatback cushion moves from the first position to the second position.

In some configurations, the furniture member includes an upholstery sheet that covers the seatback cushion and is at least partially wrapped around the aft support.

In some configurations, at least a portion of the upholstery sheet is fixed relative to the aft support.

In some configurations, the aft support is disposed closer to the upper portion of the seatback cushion than to the lower portion of the seatback cushion.

The present disclosure also provides a furniture member that may include a stationary base frame, a seat bottom frame, a seat bottom cushion, a seatback frame, and a seatback cushion. The stationary base frame may include a forward support, an aft support, and a pair of armrests that extend between the forward support and the aft support. The forward, aft and lateral supports are stationary and fixed relative to each other. The aft support is disposed vertically higher than the forward support and the armrests. The seat bottom frame may be supported by the stationary base frame. The seat bottom cushion is supported by the seat bottom frame. The seatback frame includes an upper end and a lower end. The upper end may be pivotably coupled to the aft support such that the seatback frame is rotatable relative to the aft support and the seat bottom frame between a first position and a second position. The seatback cushion is mounted on the seatback frame. The seatback cushion includes an upper end and lower end. The lower end of the seatback cushion has a greater range of motion than the upper end of the seatback cushion when the seatback frame moves between the first and second positions.

In some configurations, the seat bottom cushion is movable with the seat bottom frame relative to the stationary base frame.

In some configurations, the furniture member includes a legrest mechanism coupled to the seat bottom frame and movable relative to the stationary base frame between a retracted position and an extended position.

In some configurations, the seatback frame moves between the first and second positions in response to movement of the seat bottom frame relative to the stationary base frame.

In some configurations, the first position of the seatback frame is an upright position and the second position of the seatback frame is a reclined position.

In some configurations, the seatback cushion bends as the seatback frame moves between the first and second positions.

In some configurations, the seatback cushion bends such that a lower portion of the seatback cushion moves forward relative to the rest of the seatback cushion.

In some configurations, the furniture member includes an upholstery sheet that covers the seatback cushion and is at least partially wrapped around the aft support.

In some configurations, at least a portion of the upholstery sheet is fixed relative to the aft support.

In some configurations, the upper end of the seatback frame is disposed a first distance from the seat bottom frame when the seatback frame is in the first position. The upper end of the seatback frame may be disposed a second distance from the seat bottom frame when the seatback frame is in the second position. The second distance may be greater than the first distance.

The present disclosure also provides a furniture member that may include a stationary base frame, a seat bottom frame, and a seatback cushion. The stationary base frame may include a forward support, an aft support, and a pair of armrests that extend between the forward support and the aft support. The forward, aft and lateral supports are stationary and fixed relative to each other. The aft support is disposed vertically higher than the forward support and the armrests. The seat bottom frame is movable relative to the forward support, the aft support and the armrests. The seatback cushion may be attached to the aft support. The seatback cushion may bend in response to movement of the seat bottom frame.

In some configurations, the aft support is disposed closer to an upper portion of the seatback cushion than to a lower portion of the seatback cushion.

In some configurations, the furniture member includes a seat bottom cushion that is movable with the seat bottom frame relative to the stationary base frame.

In some configurations, the furniture member includes a legrest mechanism coupled to the seat bottom frame and movable relative to the stationary base frame between a retracted position and an extended position.

In some configurations, the furniture member includes an upholstery sheet that covers the seatback cushion and is at least partially wrapped around the aft support.

In some configurations, at least a portion of the upholstery sheet is fixed relative to the aft support.

The present disclosure also provides a furniture member that may include a stationary base frame, a seat bottom frame, and a seatback frame. The stationary base frame may include a forward support, an aft support, and a pair of armrests that extend between the forward support and the aft support. The forward, aft and lateral supports are stationary and fixed relative to each other. The aft support is disposed vertically higher than the forward support and the armrests. The seat bottom frame is supported by the stationary base frame. The seatback frame includes an upper end and a lower end. The lower end is disposed adjacent the seat bottom frame. The upper end is pivotably coupled to the aft support such that the seatback frame is rotatable relative to the aft support between a first position and a second position.

In some configurations, the seat bottom frame is movable relative to the stationary base frame.

In some configurations, the furniture member includes a legrest mechanism coupled to the seat bottom frame and movable relative to the stationary base frame between a retracted position and an extended position.

In some configurations, the seatback frame moves between the first and second positions in response to movement of the seat bottom frame relative to the stationary base frame.

In some configurations, the furniture member includes an upholstery sheet that covers the seatback frame and is at least partially wrapped around the aft support.

In some configurations, at least a portion of the upholstery sheet is fixed relative to the aft support.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a perspective view of a furniture member having a seat assembly with a recliner and legrest mechanism in a stowed position (another seat assembly of the furniture member has been removed for clarity);

FIG. 2*a* is a side view of the furniture member of FIG. 1 with the mechanism in the stowed position;

FIG. 2*b* is another side view of the furniture member of FIG. 1 with the mechanism in the stowed position and with a portion of a base frame removed for clarity;

Corresponding reference numerals indicate corresponding parts throughout the several views of the drawings.

DETAILED DESCRIPTION

Figure 1:
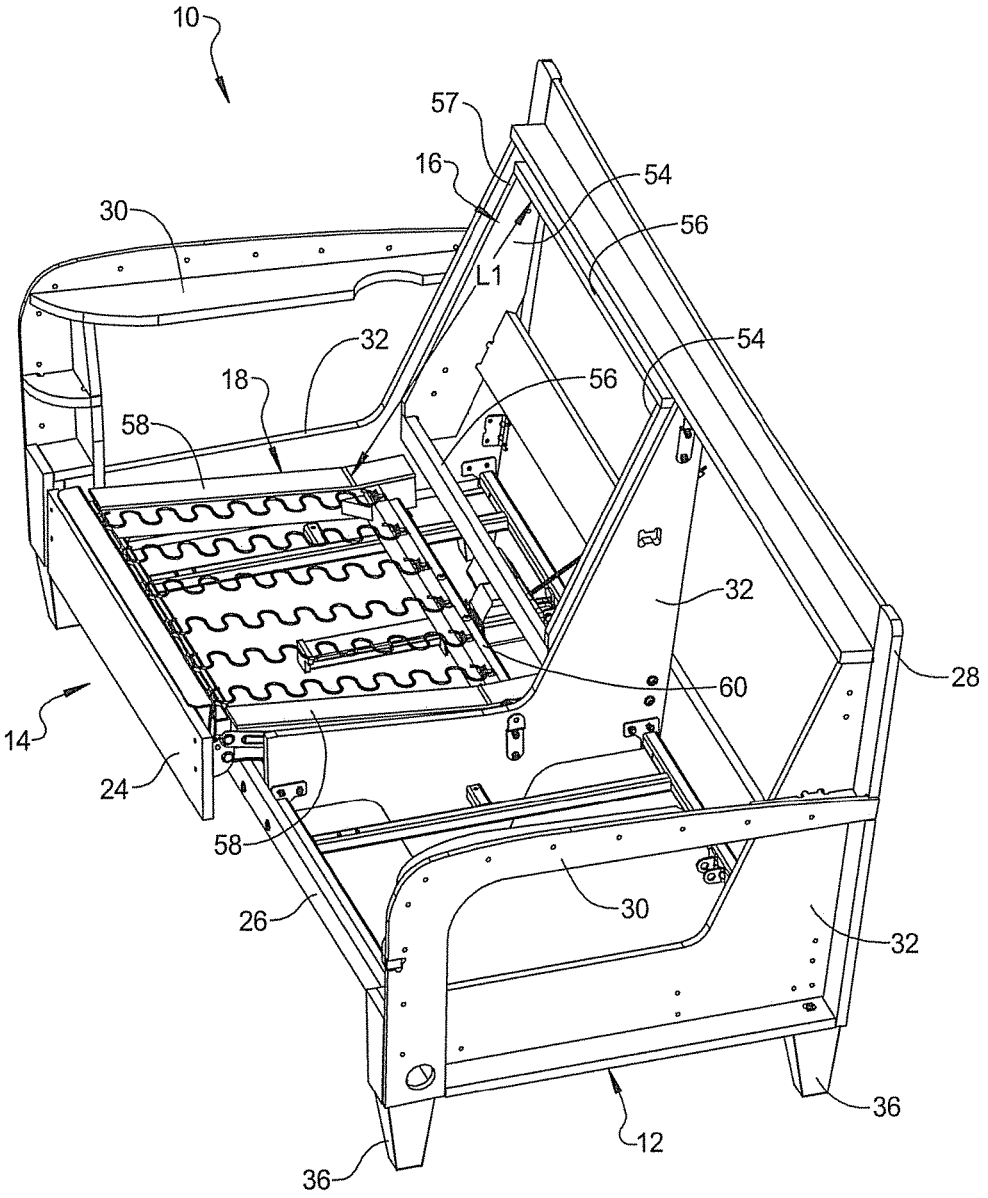

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2A:
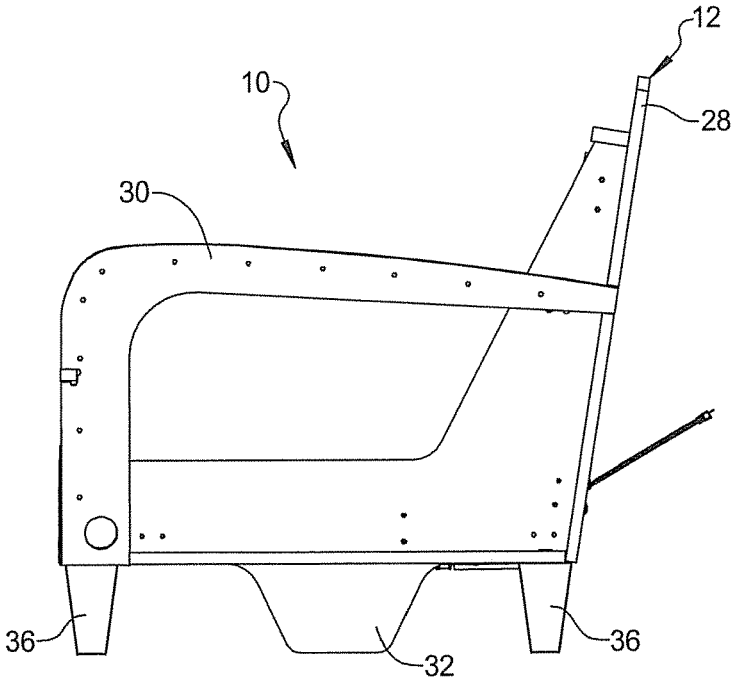
Figure 2B:
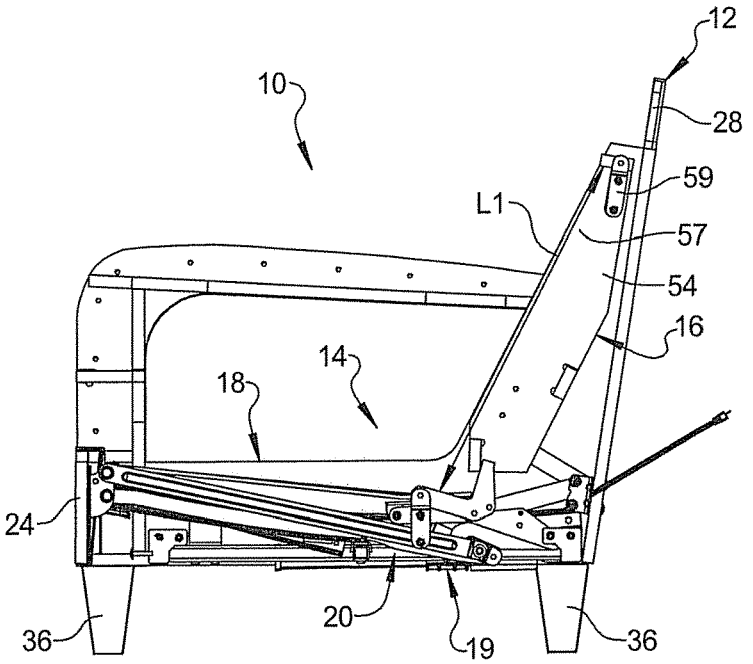
Figure 3:
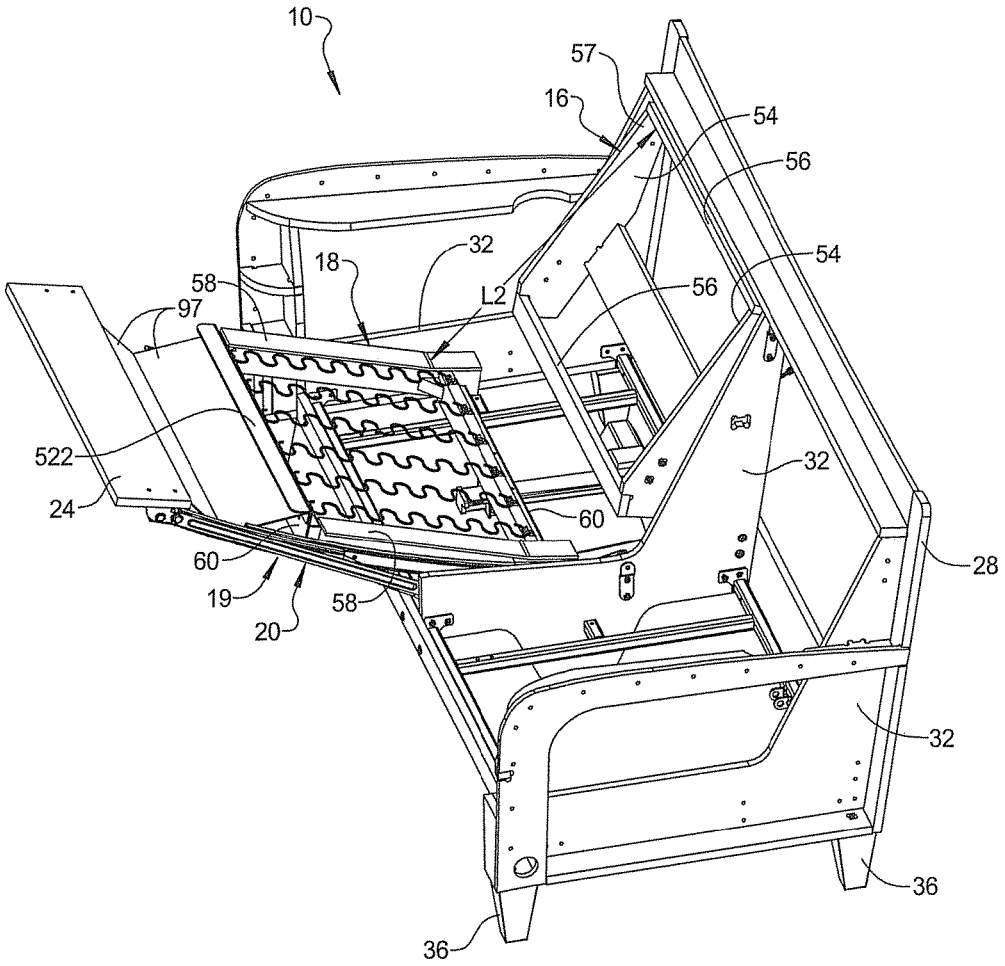
FIG. 3 is a perspective view of the furniture member of FIG. 1 with the recliner and legrest mechanism in an extended position.
Figure 4:
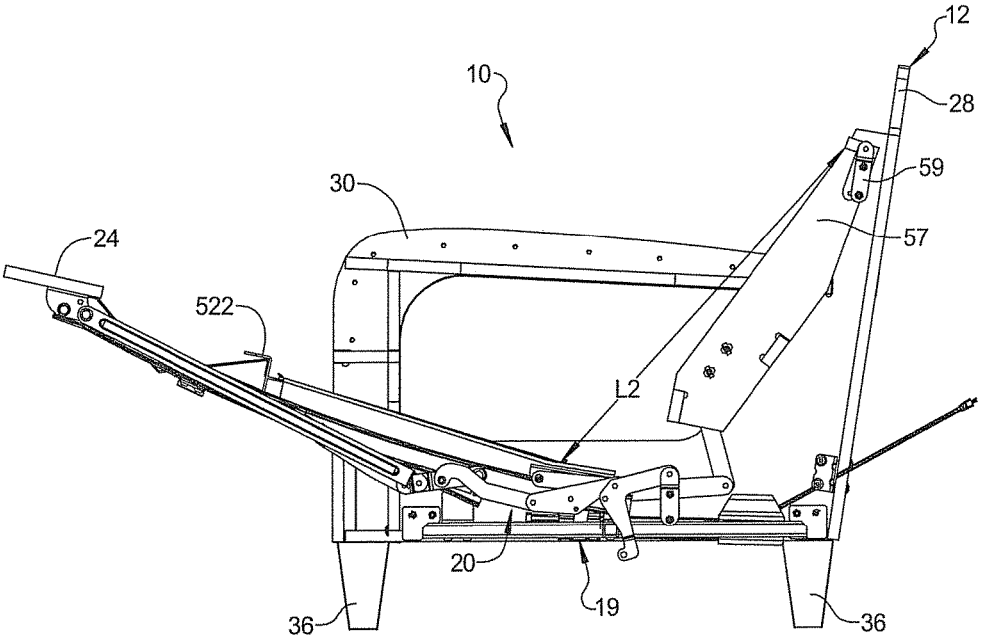
FIG. 4 is a side view of the furniture member of FIG. 1 with the mechanism in the extended position and with the portion of the base frame removed for clarity.
Figure 5:
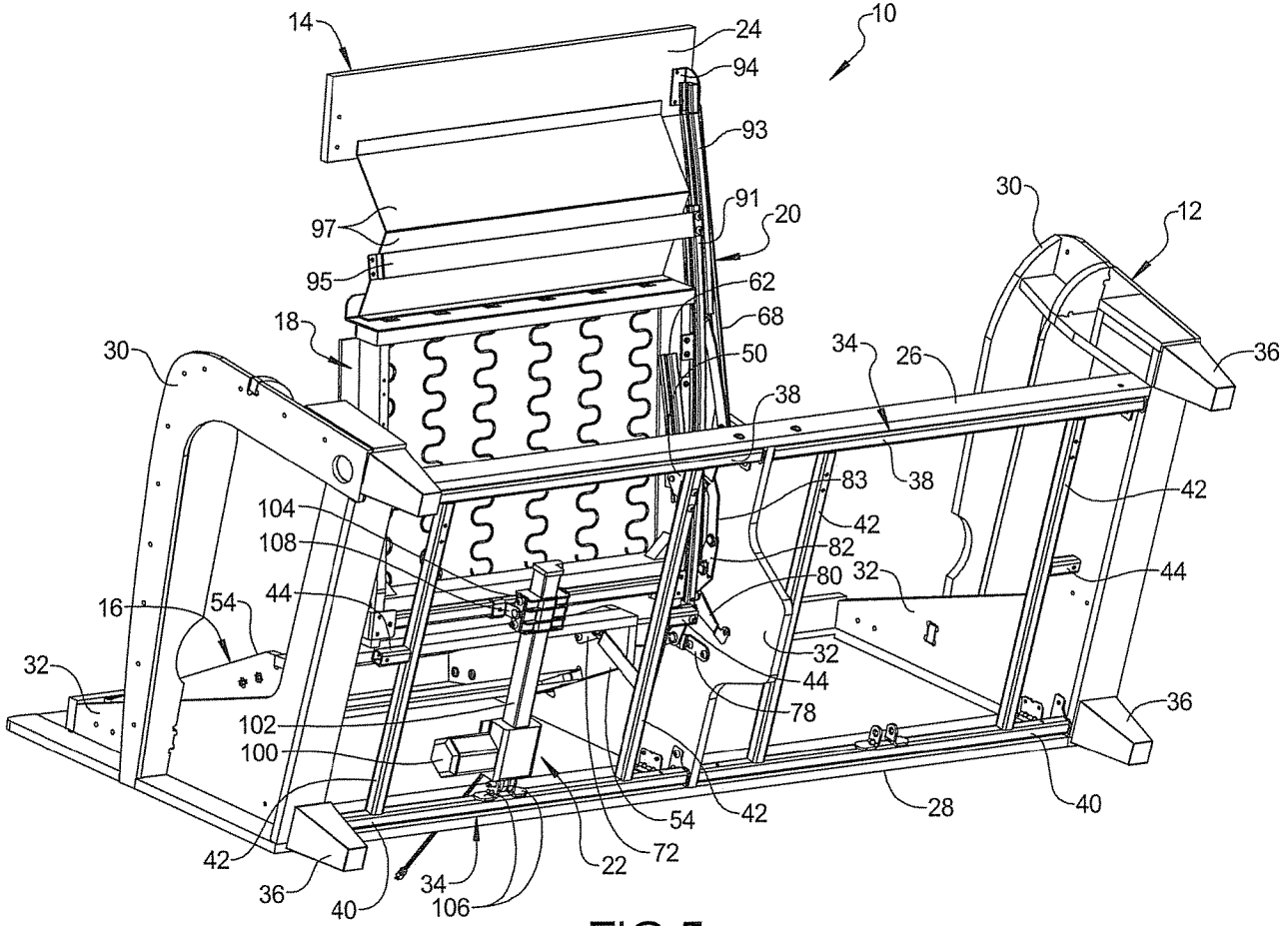
FIG. 5 is another perspective view of the furniture member of FIG. 1 with the recliner and legrest mechanism in the extended position.

With reference to FIGS. 1-6, a furniture member 10 is provided that may include a base frame 12, and one or more seat assemblies 14 (only one of which is shown in the figures). Each seat assembly 14 includes a seatback frame 16, a seat bottom frame 18, and a recliner and legrest mechanism 19. The mechanism 19 may include a pair of linkages 20 (only one of which is shown in the figures), and an actuator assembly 22 (FIG. 5). The actuator assembly 22 and linkages 20 cooperate to move the seatback frame 16 and seat bottom frame 18 relative to each other and relative to the base frame 12, while simultaneously moving a legrest platform 24 relative to the frames 12, 16, 18 between a stowed position (FIGS. 1, 2*a* and 2*b*) and an extended position (FIGS. 3 and 4). As will be described in more detail below, movement of the linkages 20 from the stowed position to the extended position also moves the seatback frame 16 from an upright position to a reclined position.

As shown in FIGS. 1 and 5, the base frame 12 may be a fixed construction including a forward support 26, an aft support 28, a pair of armrests 30, a plurality of lateral supports 32, a plurality of seat-support frames 34, and a plurality of legs 36. The lateral supports 32 extend between the forward support 26 and the aft support 28 adjacent the seatback frames 16 and the seat bottom frames 18. As shown in FIGS. 1 and 3, each seat assembly 14 is attached to and disposed between adjacent lateral supports 32.

Each of the seat-support frames 34 are disposed beneath and support a corresponding one of the seat assemblies 14. As shown in FIG. 5, each seat-support frame 34 may include front and rear rails 38, 40 and a pair of intermediate rails 42. The front and rear rails 38, 40 extend between and are fixedly attached to adjacent lateral supports 32. The intermediate rails 42 extend between and are fixedly attached to the front and rear rails 38, 40. Each of the intermediate rails 42 has a support member 44 mounted thereto and extending laterally outward therefrom. A first bracket 46 with a first roller 48 may be mounted on each of the support members 44 (see FIG. 6)(only one of the first brackets 46 and one of the first rollers 48 are shown in the figures). A second bracket 50 with a second roller 52 may be mounted on the front end of each of the intermediate rails 42 (see FIGS. 5 and 6) (only one of the second brackets 50 and one of the second rollers 52 are shown in the figures).

As shown in FIGS. 1 and 3, each seatback frame 16 may support a seatback cushion (not shown) and may include a pair of lateral support members 54 and a pair of cross members 56 extending between the support members 54. As shown in FIGS. 1-4, vertically upper ends 57 of the lateral support members 54 may be pivotably attached to the lateral supports 32 of base frame 12 via hinge brackets 59.

Because the seatback frame 16 pivots about an axis extending through the upper end of the seatback frame 16, there is no need for any clearance between the rearward-most part of the furniture member 10 (i.e., the aft support 28 of the base frame 12) and a wall (not shown) of a room (not shown) in which the furniture member 10 is situated. That is, the aft support 28 (and the rest of the base frame 12) remains stationary while the seatback frame 16 moves between the upright and reclined positions, and movement of the seat-back frame 16 into the reclined position does not cause any portion of the furniture member 10 to move any further rearward than the aft support 28. Therefore, the furniture member 10 can be placed in any desired position within the room, including a position in which the aft support 28 contacts the wall when the seatback frame 16 is in the upright position, and the seatback frame 16 can be fully reclined within the furniture member 10 remaining in the desired position within the room. Furthermore, the aft sup-port 28 could have a angled configuration (where the aft support 28 is at a non-perpendicular angle relative to the floor, as shown in FIGS. 1-4) or a vertical configuration (where the aft support 28 is perpendicular to the floor).

Each seat bottom frame 18 may support a seatback cushion (not shown) and may include a pair of lateral support members 58 and a pair of cross members 60 extending between the support members 58. Each of the lateral support members 58 of the seat bottom frame 18 may include a curved track 62 (FIGS. 5 and 6) that movably receive the second rollers 52 attached to intermediate rails 42 of the base frame 12. As shown in FIGS. 1-4, the linkages 20 are coupled to the lateral support members 54, 58 of the seatback and seat bottom frames 16, 18 such that movement of the linkages 20 between the stowed position (FIGS. 1, 2*a* and 2*b*) and the extended position (FIGS. 3 and 4) causes corresponding movement of the seatback frame 16 and the seat bottom frame 18 relative to the base frame 12 and relative movement between the seatback frame 16 and the seat bottom frame 18, as will be described in more detail below. The curved tracks 62 of the seat bottom frame 18 move relative to the second rollers 52 as the linkages 20 move between the stowed and extended positions so that the base frame 12 can movably support the seat bottom frame 18.

Figure 8:
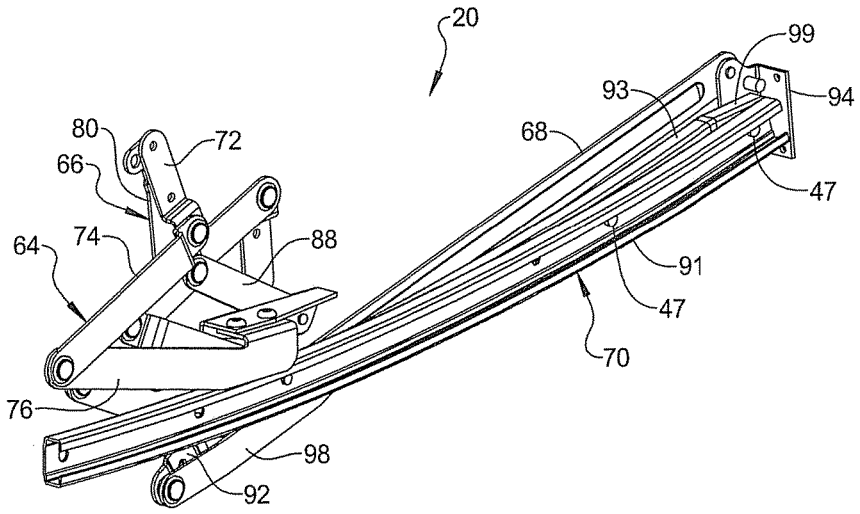
FIG. 8 is a perspective view of the recliner and legrest mechanism in the stowed position.
Figure 9:
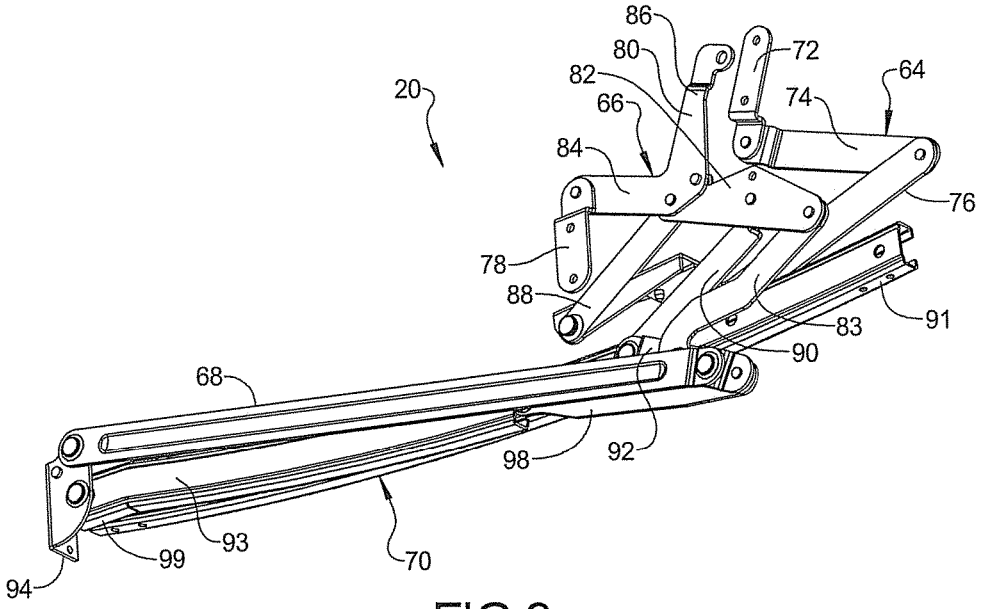
FIG. 9 is another perspective view of the recliner and legrest mechanism in the stowed position.

As shown in FIGS. 8-13, each linkage 20 may include a recliner linkage 64, a swing linkage 66, an extension link 68 and a telescoping support track assembly 70. The recliner linkages 64 are connected to the seatback frame 16 and causes the seatback frame 16 to recline (i.e., pivot about hinge brackets 59) as the mechanism 19 moves between the stowed and extended positions. Each recliner linkage 64 may include a first mounting link 72, a first connecting link 74 and a second connecting link 76. The first mounting link 72 may be fixedly attached to a corresponding one of the lateral support members 54 of the seatback frame 16, as shown in FIG. 5. As shown in FIGS. 8 and 9, opposite ends of the first connecting link 74 may be rotatably coupled to the first mounting link 72 and the second connecting link 76, respectively.

Figure 6:
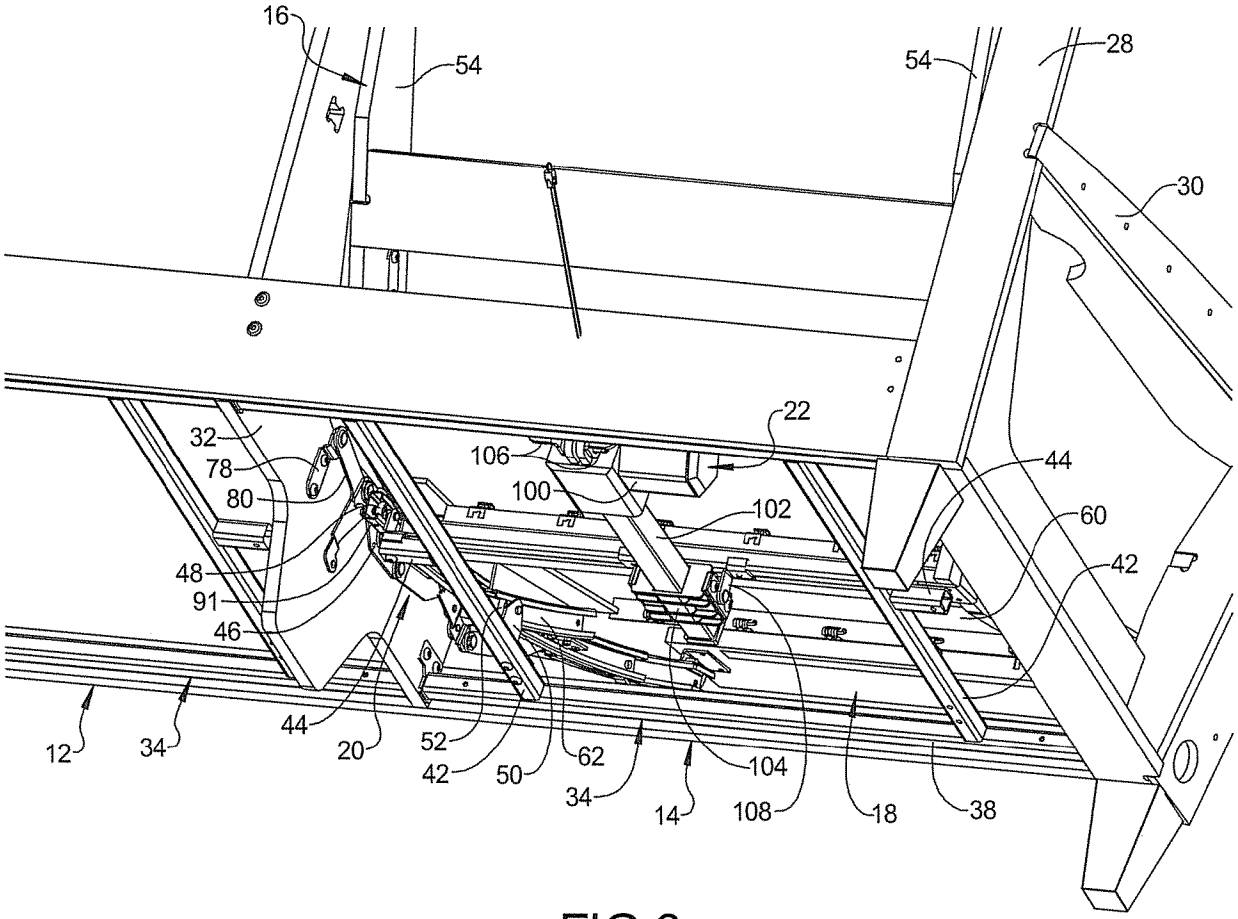
FIG. 6 is a partial perspective view of the furniture member of FIG. 1 with the recliner and legrest mechanism in the extended position.
Figure 12:
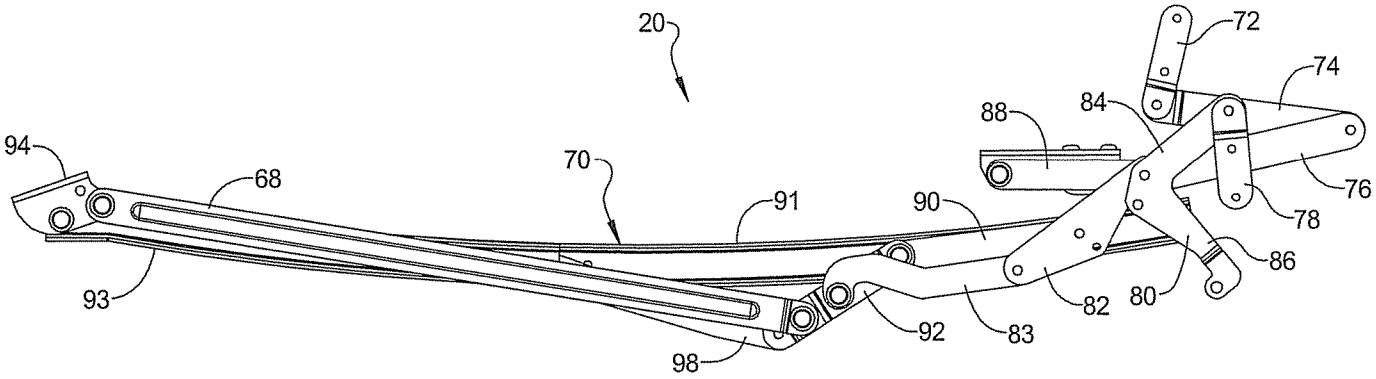
FIG. 12 is a side view of the recliner and legrest mechanism in the extended position.

As shown in FIGS. 9 and 12, the swing linkage 66 may include a second mounting link 78, a first swing link 80, a second swing link 82 and a third swing link 83. The second mounting link 78 may be fixedly attached to a corresponding one of the lateral supports 32 of the base frame 12, as shown in FIGS. 5 and 6. As shown in FIGS. 9 and 12, the first swing link 80 may include first and second legs 84, 86 cooperating to form a generally L-shaped member. A distal end of the first leg 84 may be rotatably connected to the second mounting link 78. The second swing link 82 may be a generally triangular shaped member and may be connected at a first corner to an intermediate portion of the first swing link 80 (i.e., at or near an intersection of the first and second legs 84, 86), as shown in FIGS. 9 and 12. A second corner of the second swing link 82 may be rotatably connected to the third swing link 83. In some configurations, a third corner of the second swing link 82 could be connected to a distal end of the second leg 86 of the first swing link 80 by a spring (not shown) or other resiliently stretchable member. The first corner of the second swing link 82 and/or the intermediate portion of the first swing link 80 may be rotatably coupled to a first intermediate link 88 (FIGS. 9 and 12). The first intermediate link 88 may also be rotatably coupled to the second connecting link 76 of the recliner linkage 64. A central portion of the second swing link 82 may be rotatably coupled to a second intermediate link 90 (FIGS. 9 and 12).

Figure 7:
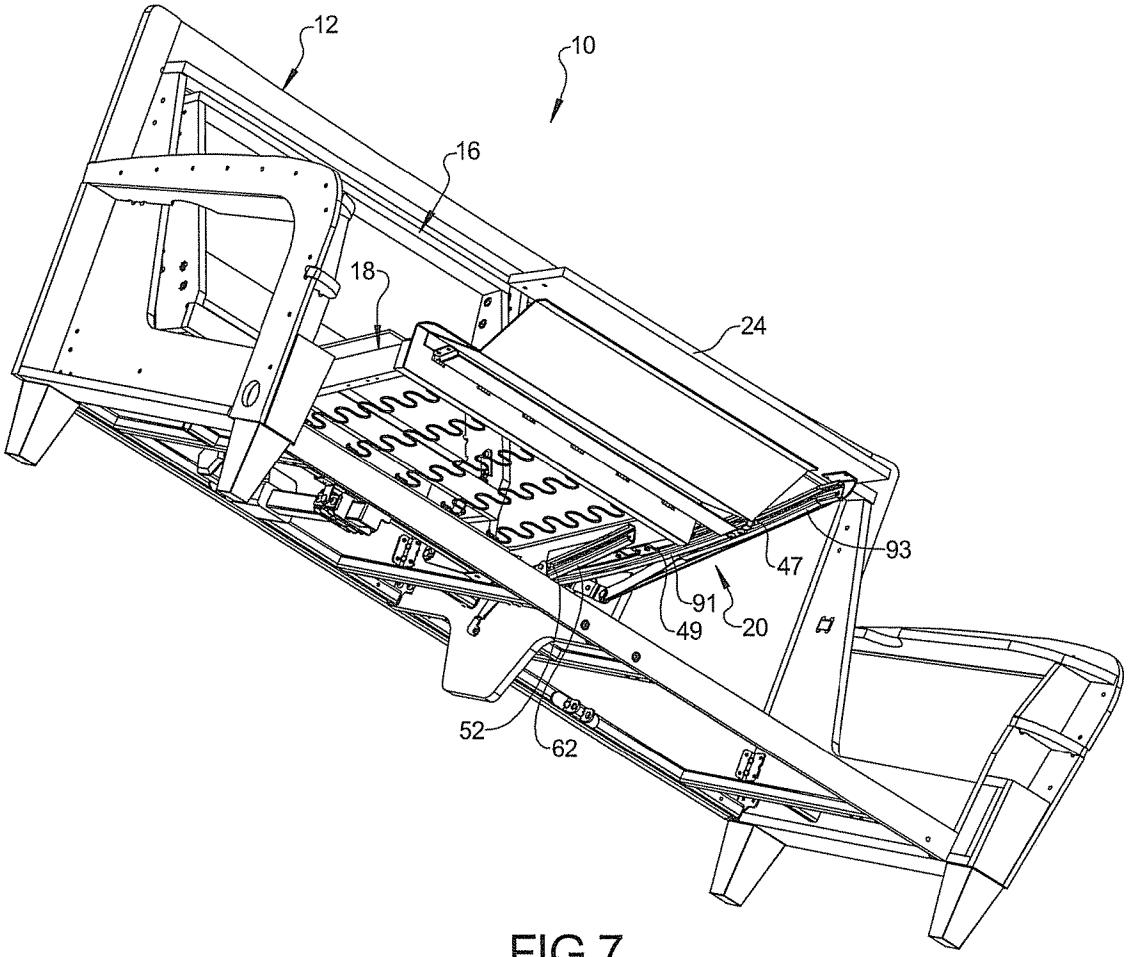
FIG. 7 is another perspective view of the furniture member of FIG. 1 with the recliner and legrest mechanism in the extended position.

As shown in FIGS. 8, 9, 12 and 13, the telescoping support track assembly 70 may include a curved first track member 91 and a curved second track member 93 that are slidably attached to each other so that the second track member 93 can slide outward relative to the first track member 91 as the mechanism 19 moves from the stowed position to the extended position. For example, one or more third rollers 47 (FIGS. 7 and 8) may be attached to the first track member 91 and may rollingly engage the second track member 93 to facilitate the relative movement between the first and second track members 91, 93. A distal end portion 99 (FIGS. 8 and 9) of the second track member 93 may be angled relative to the rest of the second track member 93 such that the end portion 99 extends downward as the end portion 99 extends outward from the rest of the second track member 93.

Figure 10:
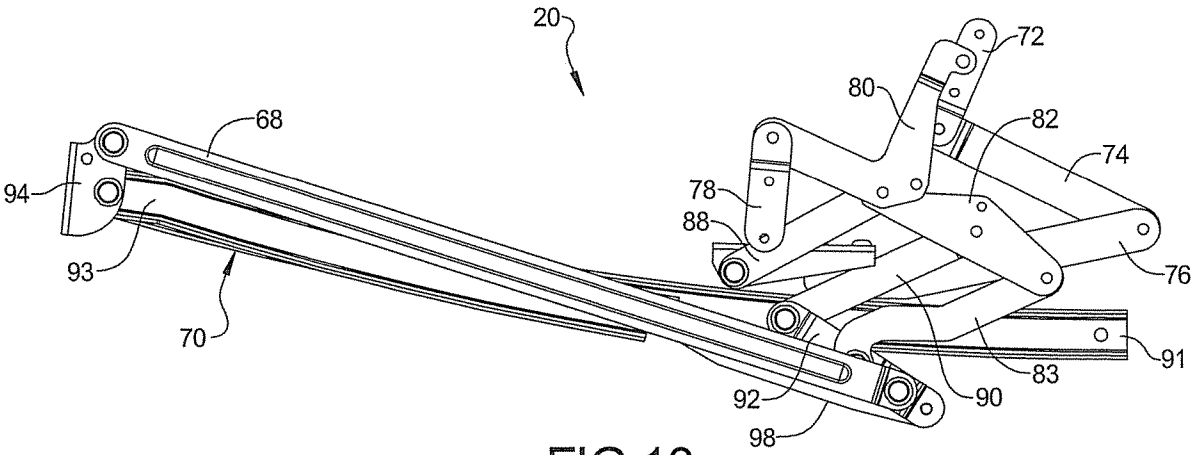
FIG. 10 is a side view of the recliner and legrest mechanism in the stowed position.
Figure 11:
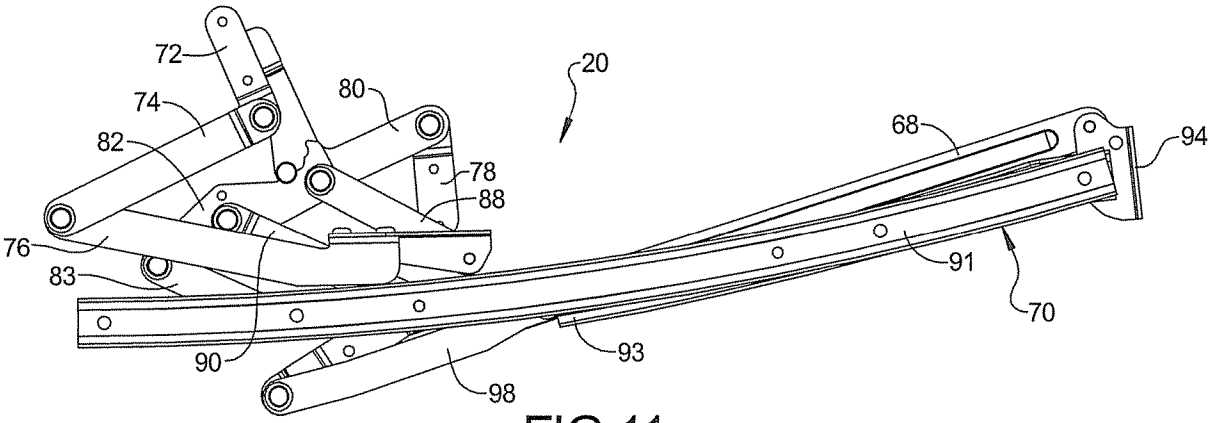
FIG. 11 is another side view of the recliner and legrest mechanism in the stowed position.
Figure 13:
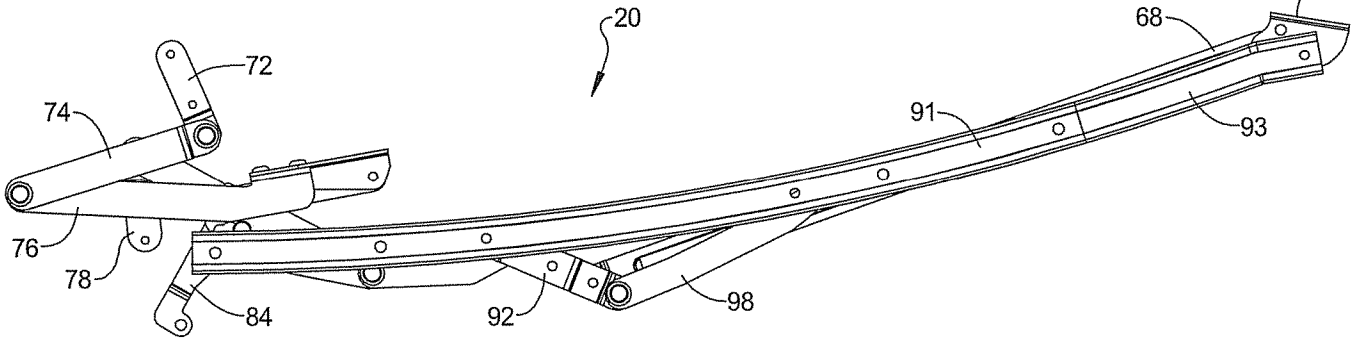
FIG. 13 is another side view of the recliner and legrest mechanism in the extended position.
Figure 14:
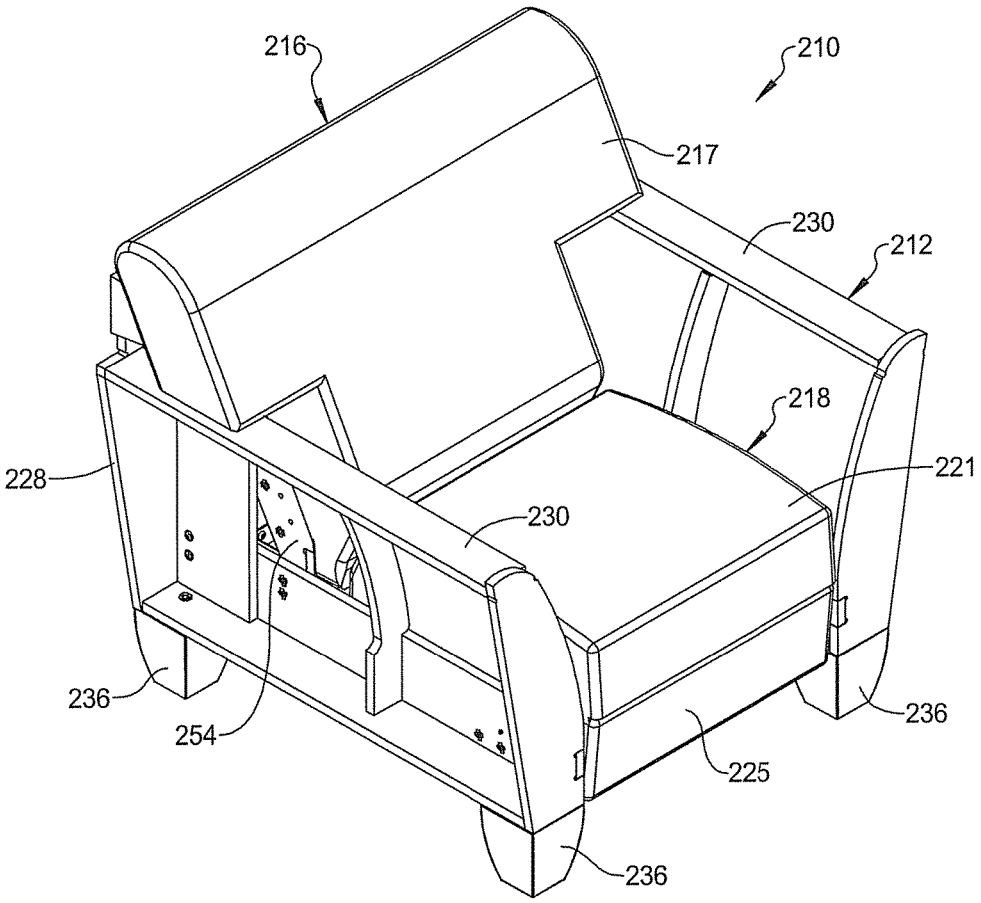
FIG. 14 is a perspective view of another furniture member having a seat assembly with a recliner and legrest mechanism in a stowed position.

As shown in FIGS. 10, 12 and 13, the second track member 93 and the extension link 68 are rotatably coupled to a third mounting bracket 94 to which the legrest platform 24 is fixedly mounted (FIG. 5). As shown in FIG. 6, the first track member 91 receives the first roller 48 so that the intermediate rail 42 can support the first track member 91 while allowing the first track member 91 to move relative to the first roller 48. The first track member 91 may also receive a fourth roller 49 (FIG. 7) attached to the seat bottom frame 18 so that the first track member 91 can support the seat bottom frame 18. In some configurations, the first track member 91 may be fixedly attached to and support a chaise panel support member 95 (FIG. 5) that may support one or more foldable chaise panels 97.

As shown in FIGS. 10, 12 and 13, a throw arm 92 may movably connect the swing linkage 66 to the extension link 68 and the support track assembly 70. A first end of the throw arm 92 may be rotatably coupled to an end of the second intermediate link 90. The first end of the throw arm 92 is also rotatably coupled to the first track member 91. A connecting link 98 may be rotatably coupled to a second end of the throw arm 92 and rotatably coupled to the second track member 93. A first intermediate portion of the throw arm 92 may be rotatably coupled to the extension link 68. A second intermediate portion of the throw arm 92 (between the first end and the first intermediate portion) may be rotatably coupled to the third swing link 83. In some configurations, rotation of the throw arm 92 determines timing of movement of the seatback frame 16, the seat bottom frame 18 and the legrest platform 24 (extension and rotation of the legrest platform 24) relative to the base frame.

As shown in FIGS. 5 and 6, the actuator assembly 22 may include a motor 100, a guide member 102 and a slide member 104. The guide member 102 may be rotatably coupled to the rear rail 40 of the base frame 12 by brackets 106. The slide member 104 may be slidable along the guide member 102 and may be rotatably coupled to the seat bottom frame 18 by brackets 108. Operation of the motor 100 in a first direction may cause the slide member 104 to move along the guide member 102 away from the motor 100, which causes the seat bottom frame 18 and the linkages 20 to move toward the extended position, which in turn, causes the seatback frame 16 to simultaneously move toward a reclined position. Operation of the motor 100 in a second direction may cause the slide member 104 to move along the guide member 102 toward the motor 100, which causes the seat bottom frame 18 and the linkages 20 to move toward the stowed position, which in turn, causes the seatback frame 16 to simultaneously move toward an upright position. Because the linkages 20 are able to simultaneously move the legrest platform 24, the seat bottom frame 18 and the seatback frame 16, the mechanism 19 only needs to incorporate a single motor (rather than one motor for legrest extension and another for seatback reclining). Therefore, a two-button controller can be implemented to control the motor 100 (e.g., one button for moving the mechanism 19 toward the extended position, and another button for moving the mechanism 19 toward the stowed position).

As the mechanism 19 moves between the stowed and extended positions, the curved first track member 91 provides a curved guide path for seat bottom, seatback and legrest movement. The curved form of the second track member 93 is shaped to provide: (1) a slight dipping movement during the initial extension of the linkage 20 so that the upholstery of the legrest platform 24 will clear the upholstery of the seat bottom (i.e., as one of the rollers 47 attached to the first track member 91 traverses the angled distal end portion 99 (FIGS. 8 and 9) of the second track member 93); and (2) subsequent movement (as the linkage 20 continues to move toward the extended position) that extends and lifts the legrest platform 24 to lift and support the occupant's legs. In this manner, the first and second track members 91, 93 cooperate in unison to provide the extension and lifting movement of the legrest platform 24.

The configuration of the mechanism 19 described above and shown in the figures provides several benefits and advantages over conventional linkages. For example, the telescoping action of the support track assembly 70 and the movement of the support track assembly 70 and seat bottom frame 18 along the rollers 48, 52 allow for further extension of the legrest platform 24 when the mechanism 19 is in the extended position while also allowing the mechanism 19 to be stowed into a more compact (i.e., "low-profile") area when the mechanism 19 is in the stowed position. This allows the furniture member 10 to provide as much or more comfort in the fully extended position as a conventional recliner, while also allowing the furniture member to have the same aesthetic appearance and design cues of popular stationary furniture.

That is, the configuration of the mechanism 19 allows for a variety of shapes and configurations of the base frame 12 that are not found in conventional motion furniture. For example, the base frame 12 can include a high-leg configuration (e.g., with legs 36 being 5.5 inches high in some embodiments) with no part of the mechanism 19 being visible when the mechanism 19 is in the stowed position, as shown in FIG. 2*a*. Additionally, the furniture member 10 can have a low seat-frame-height (e.g., 11.5 inches from the floor to the top of the seat bottom frame 18 in the stowed position). This combination of high legs and low seat-frame-height leaves a very small area into which the entire mechanism 19 is packaged in the stowed position.

Furthermore, the particular furniture member 10 depicted in FIGS. 1-13 and 25-28, a depth (i.e., the direction extending between the front (forward) end and the back (aft) end of the furniture member) of the furniture member 10 is about 32 inches at a height where the legs 36 attach to the base frame 12. This depth dimension only leaves about 30 inches of space for the mechanism 19 in the stowed position. The legrest platform 24 may be about 6 inches tall and may extend forward from the front end of the seat bottom frame 18 by about 19 inches in the fully extended position. To achieve the above large ranges of motion while maintaining the mechanism 19 hidden from view in the stowed position, the mechanism 19 is configured in a way that makes the mechanism 19 very low-profile and capable of a large amount of extension.

The long range of motion of the linkages 20 allow the seatback frame 16 and the legrest platform 24 to be in a "zero-gravity" position when the mechanism 19 is in the fully extended position. This "zero gravity" position may be particularly comfortable for many users, as the user's feet (resting on the fully extended legrest platform 24) will be positioned at or near the vertical level (i.e., the vertical distance off of the ground) of the user's heart. This "zero-gravity" positioning of the user's body in the furniture member 10 promotes restfulness and relaxation.

Furthermore, the construction of the mechanism 19 and the manners in which the seatback frame 16 and seat bottom frame 18 move relative to each other and relative to the base frame 12 allow for an effective "lengthening" of the seatback frame 16 as the mechanism 19 moves between the fully stowed and fully extended positions. That is, an effective length of the seatback or a distance L1 (FIGS. 1 and 2B) between an upper portion of the seatback frame 16 and a particular location on the seat bottom frame 18 will increase as the seatback frame 16 reclines and the mechanism 19 moves between the stowed and extended positions (see effective length or distance L2 in FIGS. 3 and 4). The seat bottom frame 18 travels forward relative to the base frame 12 by about seven inches as the mechanism 19 moves between the fully stowed and fully extended positions. This effective length change or separation between the seatback frame 16 and the seat bottom frame 18 allows the user's body to experience a larger amount of back recline than the actual angle change of the seatback frame 16 relative to the base frame 12 between the fully upright and reclined positions. As a non-limiting example, the distance L1 may be about 23.75 inches, and the distance L2 may be about 27 inches.

It will be appreciated that the mechanism 19 could be incorporated into a single-seat chair, a motion sofa, a motion loveseat or any style or type of furniture member. Furthermore, while the mechanism 19 is described above as being powered by the motor-driven actuator assembly 22, in some configurations, the linkages 20 could be manually powered.

Figure 17:
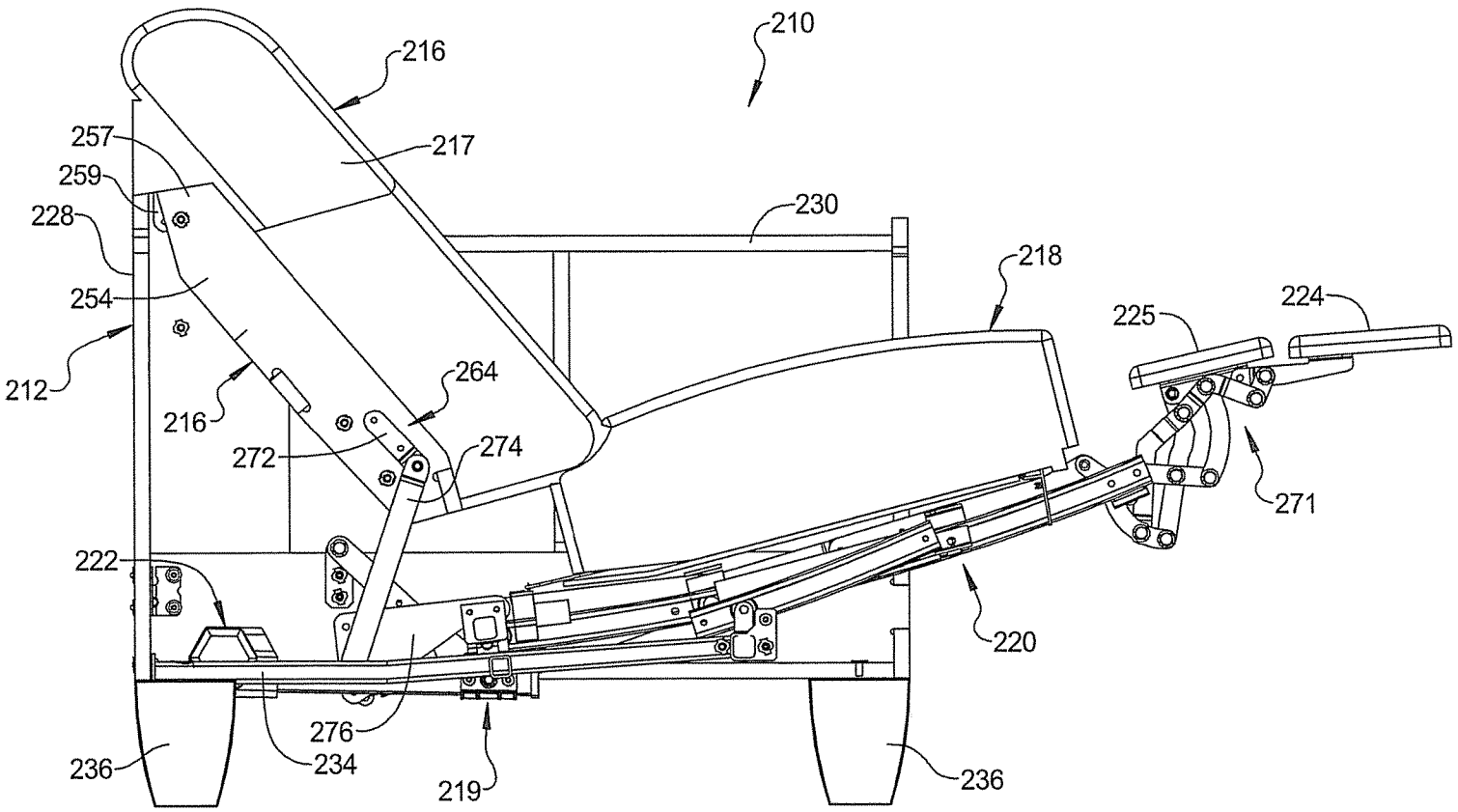
FIG. 17 is a side view of the furniture member of FIG. 14 with the mechanism in the extended position and with the portion of the base frame removed for clarity.
Figure 18:
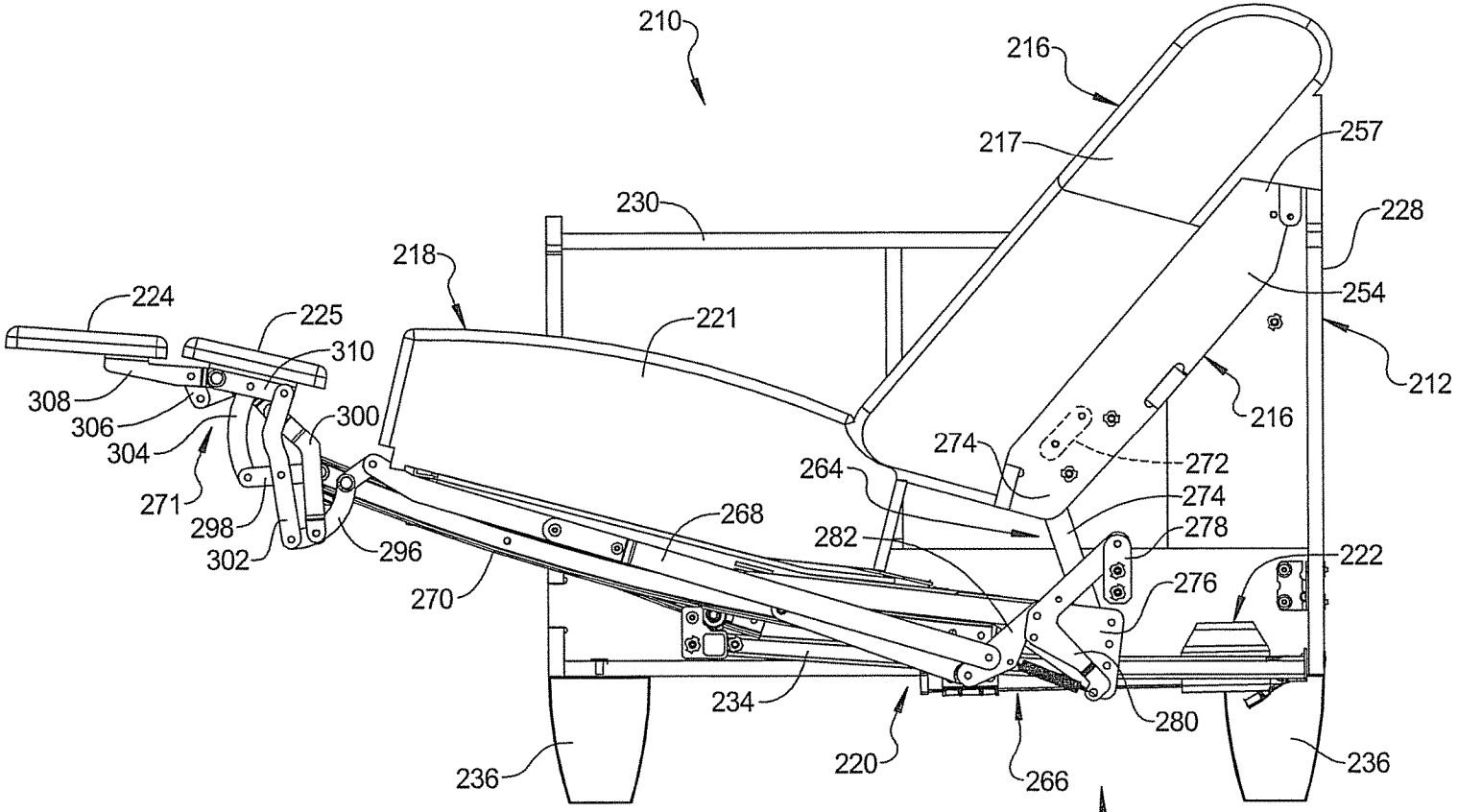
FIG. 18 is another side view of the furniture member of FIG. 14 with the mechanism in the extended position and with another portion of the base frame removed for clarity.
Figure 19:
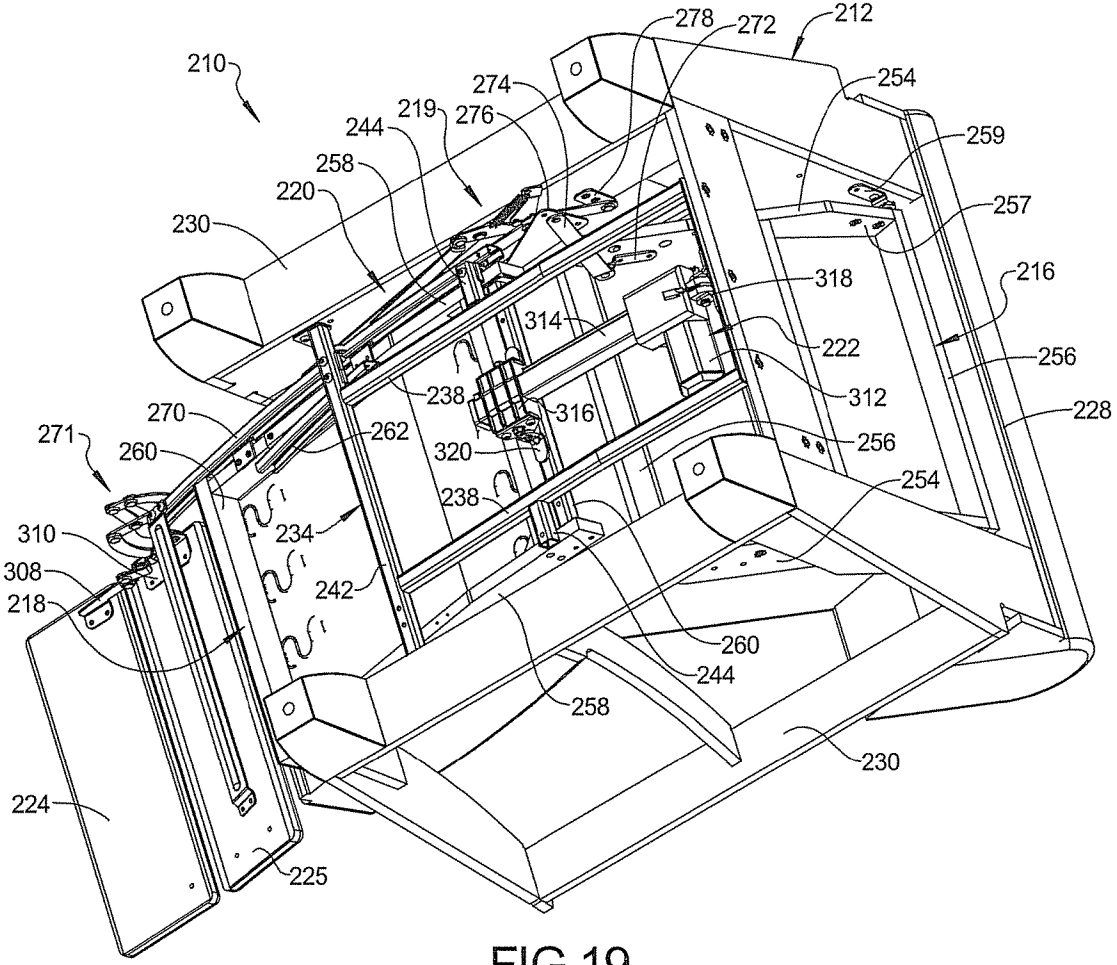
FIG. 19 is a perspective view of the furniture member of FIG. 14 with the mechanism in the extended position.
Figure 20:
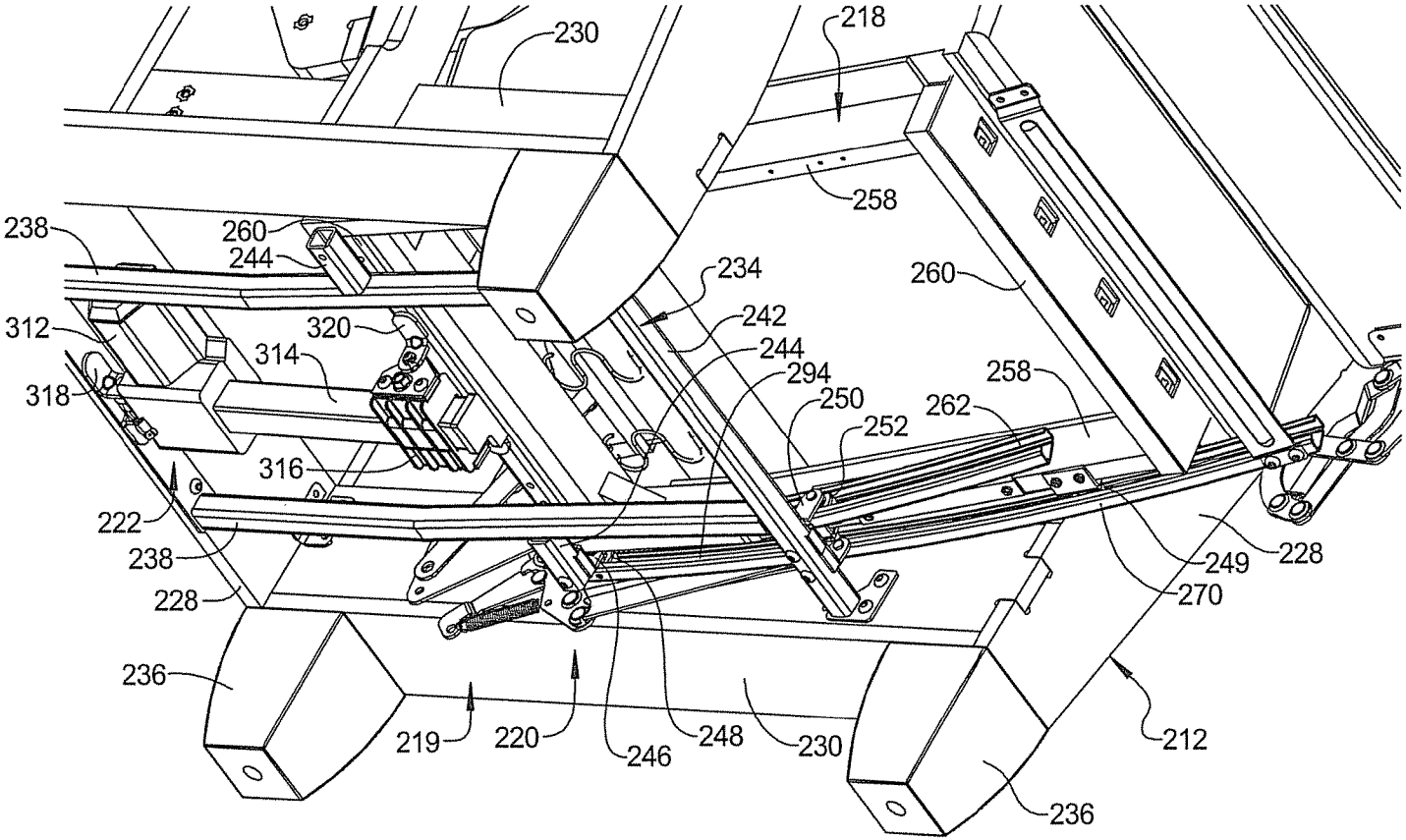
FIG. 20 is a partial perspective view of the furniture member of FIG. 14 with the mechanism in the extended position.
Figure 21:
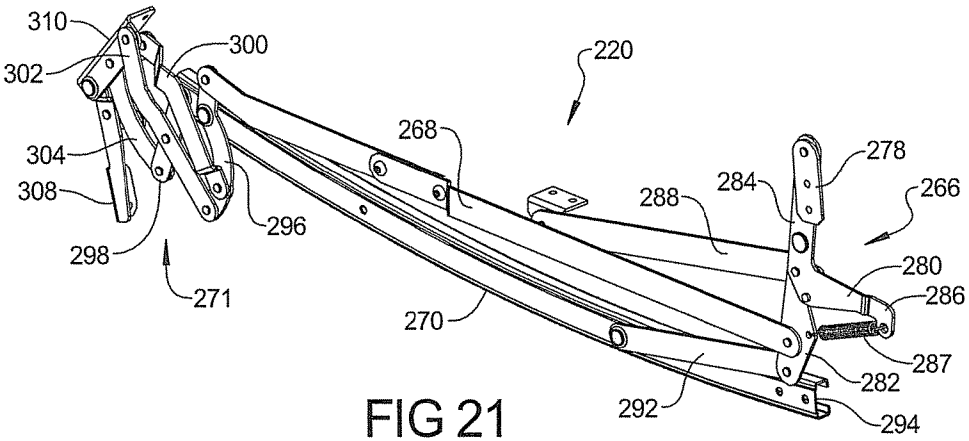
FIG. 21 is a perspective view of a portion of the mechanism in a position between the stowed and extended positions.
Figure 22:
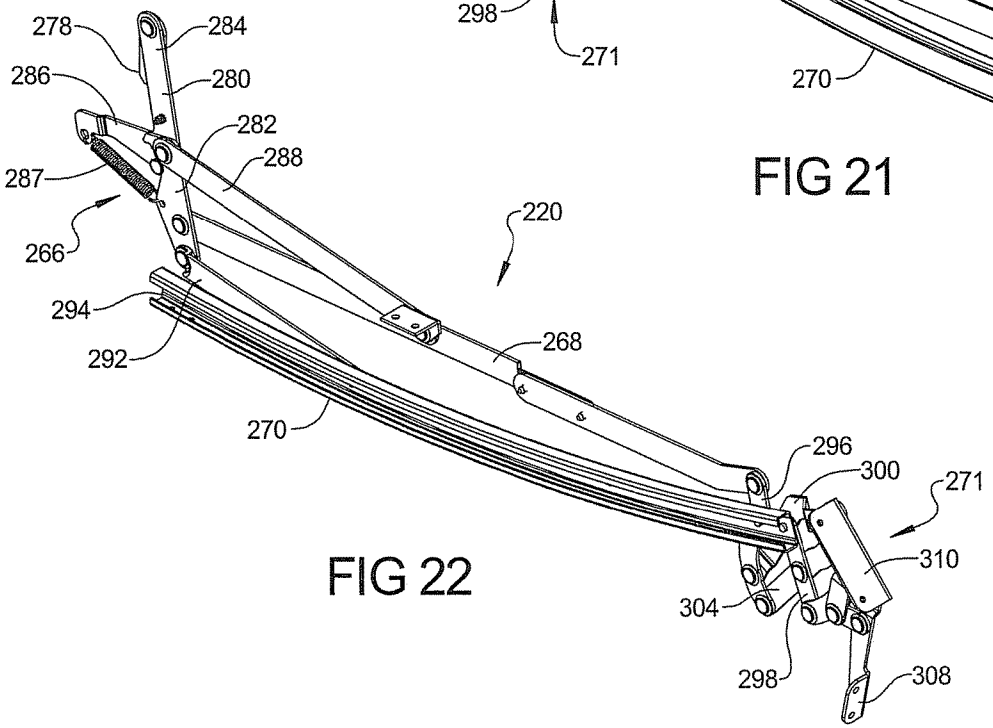
FIG. 22 is another perspective view of the portion of the mechanism in the position of FIG. 21.
Figure 23:
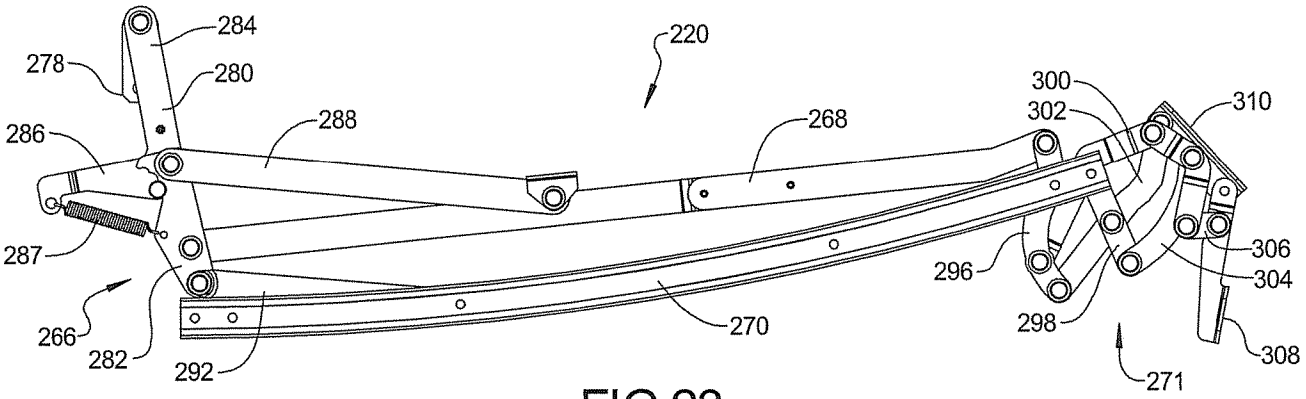
FIG. 23 is a side view of the portion of the mechanism in the position of FIG. 21.
Figure 24:
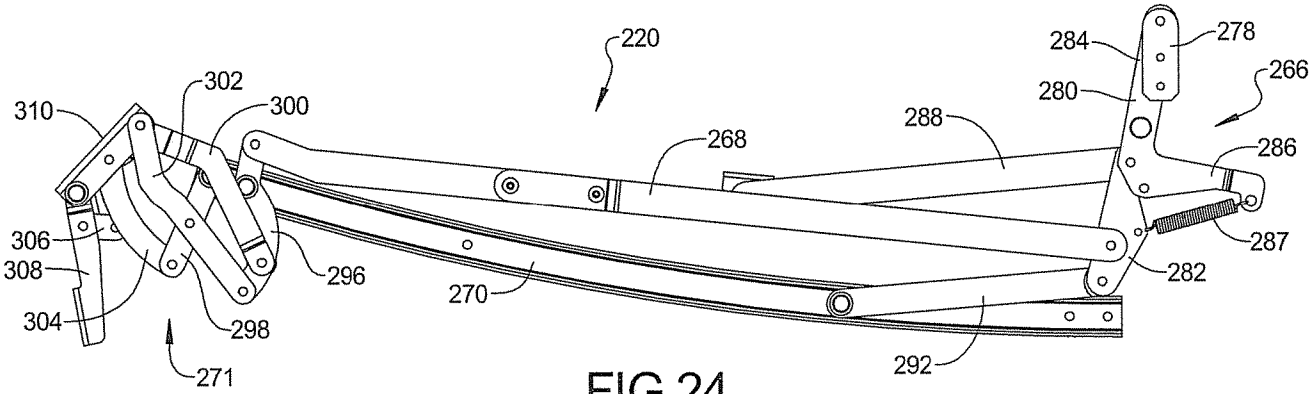
FIG. 24 is another side view of the portion of the mechanism in the position of FIG. 21.
Figure 25:
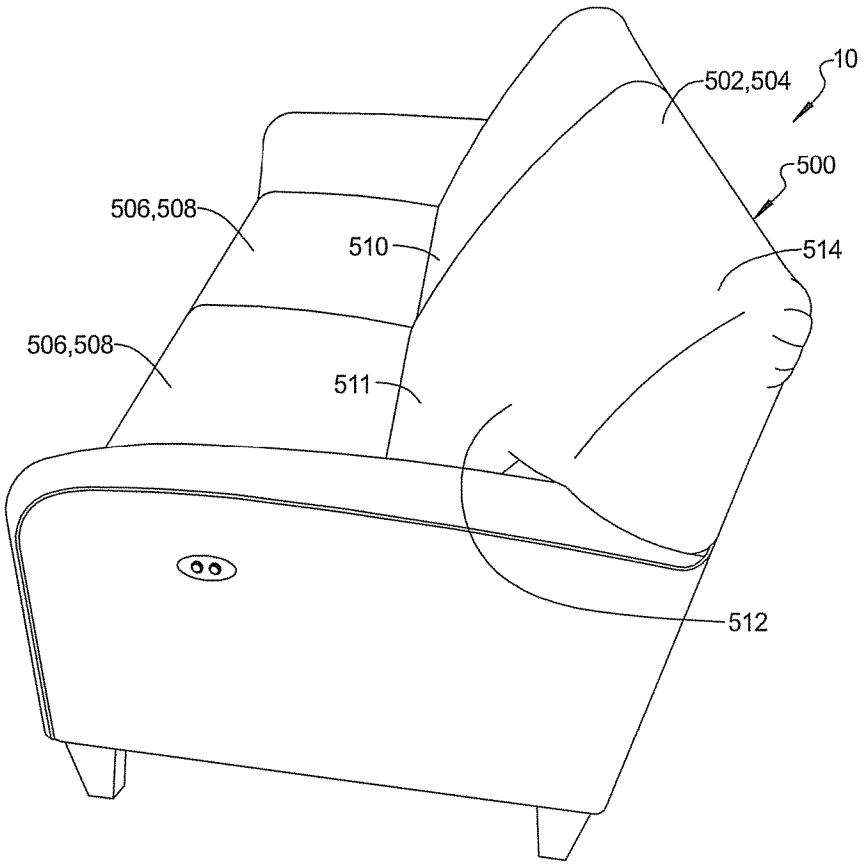
FIG. 25 is a perspective view of the furniture member of FIG. 1 in the stowed position having an upholstery system according to the principles of the present disclosure.

With reference to FIGS. 14-20, a furniture member 210 is provided that may include a base frame 212, a seatback frame 216, a seat bottom frame 218, and a recliner and legrest mechanism 219. The mechanism 219 may include a pair of linkages 220 (only one of which is shown in the figures), and an actuator assembly 222 (FIGS. 19 and 20). The actuator assembly 222 and linkages 220 cooperate to move the seatback frame 216 and seat bottom frame 218 relative to each other and relative to the base frame 212, while simultaneously moving a legrest platform 224 (FIGS. 16 and 17) relative to the frames 212, 216, 218 between a stowed position (FIGS. 14-16) and an extended position (FIGS. 17-20). As will be described in more detail below, movement of the linkages 220 from the stowed position to the extended position also moves the seatback frame 216 from an upright position to a reclined position.

As shown in FIGS. 14-20, the base frame 212 may be a fixed construction including an aft support 228, a pair of side frames 230, a seat-support frame 234, and a plurality of legs 236. The seat-support frame 234 is disposed beneath and supports the seat bottom frame 218 and the linkages 220. As shown in FIG. 19, the seat-support frame 234 may include a pair of fore/aft extending rails 238 and a cross rail 242. The fore/aft extending rails 238 are fixedly attached to the cross rail 242 and extend from the cross rail 242 to the aft support 228. The cross rails 242 extends between and is fixedly attached to the side frames 230. Each of the fore/aft extending rails 238 has a support member 244 and extending laterally outward therefrom. A first bracket 246 with a first roller 248 may be mounted on each of the support members 244 (see FIG. 19)(only one of the first brackets 246 and one of the first rollers 248 are shown in the figures). A pair of second brackets 250 (only one shown in the figures) each having a third roller 252 may be mounted on the cross rail 242 (see FIG. 20).

Each seatback frame 216 may support a seatback cushion 217 (FIGS. 14-17) and may include a pair of lateral support members 254 and a pair of cross members 256 extending between the support members 254 (FIG. 19). Upper ends 257 of the lateral support members 254 may be pivotably attached to the base frame 212 via hinge brackets 259 (FIG. 19). Because the seatback frame 216 pivots about an axis extending through the upper end of the seatback frame 16, there is no need for any special or additional clearance between the rearward-most part of the furniture member 210 (e.g., the aft support 228 of the base frame 212) and a wall (not shown) of a room (not shown) in which the furniture member 210 is situated. That is, the aft support 228 (and the rest of the base frame 212) remains stationary while the seatback frame 216 moves between the upright and reclined positions, and movement of the seatback frame 216 into the reclined position does not cause any portion of the furniture member 210 to move any further rearward than it was positioned in the upright position.

Figure 16:
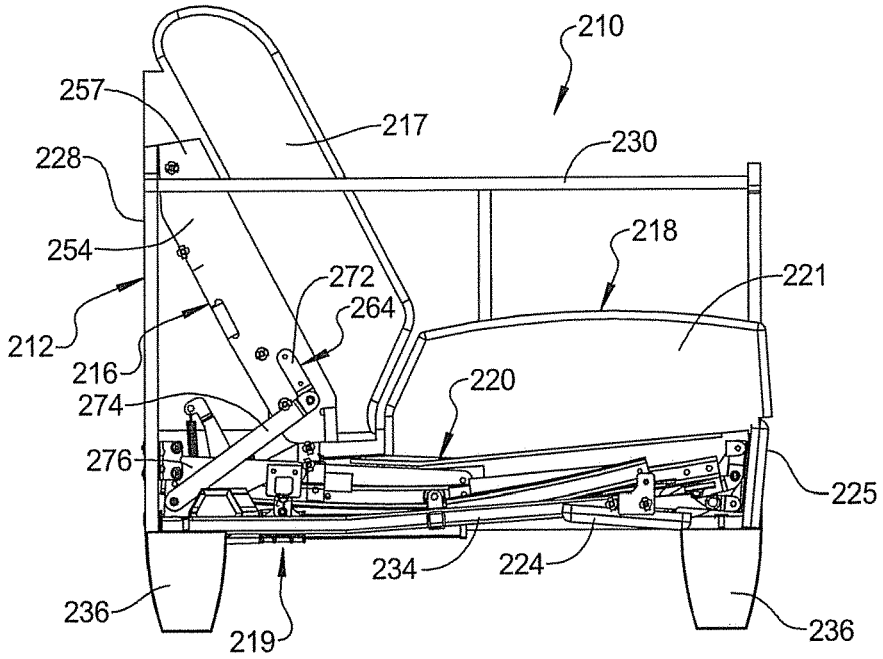
FIG. 16 is another side view of the furniture member of FIG. 14 with the mechanism in the stowed position and with a portion of a base frame removed for clarity.

Each seat bottom frame 218 may support a seatback cushion 221 and may include a pair of lateral support members 258 and a pair of cross members 260 extending between the support members 258. Each of the lateral support members 258 of the seat bottom frame 218 may include a curved track 262 (FIGS. 19 and 20) that movably receive the second rollers 252 attached to the cross rail 242 of the base frame 212. As shown in FIGS. 16 and 17, the linkages 220 are coupled to the lateral support members 254, 258 of the seatback and seat bottom frames 216, 218 such that movement of the linkages 220 between the stowed position and the extended position causes corresponding movement of the seatback frame 216 and the seat bottom frame 218 relative to the base frame 212 and relative movement between the seatback frame 216 and the seat bottom frame 218, as will be described in more detail below. The curved tracks 262 of the seat bottom frame 218 move relative to the second rollers 252 as the linkages 220 move between the stowed and extended positions so that the base frame 212 can movably support the seat bottom frame 218.

Each linkage 220 may include a recliner linkage 264 (FIGS. 16 and 17), a swing linkage 266 (FIGS. 21-24), an extension link 268 (FIGS. 21-24), a curved support track 270 (FIGS. 21-24), and a pantograph linkage 271 (FIGS. 21-24). The recliner linkages 264 are connected to the seatback frame 216 and causes the seatback frame 216 to recline (i.e., pivot about hinge brackets 259) as the mechanism 219 moves between the stowed and extended positions. Each recliner linkage 264 may include a first mounting link 272, a first connecting link 274 and a second connecting link 276 (FIGS. 18 and 19). The first mounting link 272 may be fixedly attached to a corresponding one of the lateral support members 254 of the seatback frame 216, as shown in FIGS. 18 and 19. Opposite ends of the first connecting link 274 may be rotatably coupled to the first mounting link 272 and the second connecting link 276, respectively. The second connecting link 276 may also be fixedly attached to the lateral support member 258 of the seat bottom frame 218 (as shown in FIG. 19) such that movement of the seat bottom frame 218 causes corresponding movement of the recliner linkage 264 to move the seatback frame 216 between an upright position (FIG. 16) and a reclined position (FIG. 17).

As shown in FIGS. 21-24, the swing linkage 266 may include a second mounting link 278, a first swing link 280 and a second swing link 282. The second mounting link 278 may be fixedly attached to a corresponding one of the side frames 230 of the base frame 212, as shown in FIG. 19. As shown in FIGS. 21-24, the first swing link 280 may include first and second legs 284, 286 cooperating to form a generally L-shaped member. A distal end of the first leg 284 may be rotatably connected to the second mounting link 278. The second swing link 282 may be a generally triangular shaped member and may be connected at a first corner to an intermediate portion of the first swing link 280 (i.e., at or near an intersection of the first and second legs 284, 286). A second corner of the second swing link 282 may be rotatably connected to a throw link 292 that is also rotatably connected to the support track 270. A third corner of the second swing link 282 may be connected to a distal end of the second leg 286 of the first swing link 280 by a spring 287 or other resiliently stretchable member. The first corner of the second swing link 282 and/or the intermediate portion of the first swing link 280 may be rotatably coupled to a first intermediate link 288. The first intermediate link 288 may be attached to and support the seat bottom frame 18. A central portion of the second swing link 82 may be rotatably coupled to the extension link 268.

The support track 270 may be a curved member having a channel 294 that movably receives the first roller 248 (attached to the base frame 212) and a second roller 249 (attached to the seat bottom frame 218), as shown in FIG. 20. In this manner, the rollers 248, 249 movably support the linkages 220 and the seat bottom frame 218.

As shown in FIGS. 21-24, the pantograph linkage 271 may include first and second throw links 296, 298, first, second and third intermediate links 300, 302, 304, a connecting link 306, and first and second support links 308, 310. The first throw link 296 may be rotatably coupled to the support track 270, the extension link 268 and the first and second intermediate links 300, 302. The second throw link 298 may be rotatably coupled to the support track 270, the second intermediate link 302 and the third intermediate link 304. The first, second and third intermediate links 300, 302, 304 may be rotatably coupled to the second support link 310. The first support link 308 may be rotatably coupled to the second support link 310 and the connecting link 306. The first support link 308 may be attached to and support the legrest platform 224, as shown in FIG. 17. The second support link 310 may be attached to and support an intermediate legrest platform 225, as shown in FIG. 17.

As shown in FIGS. 19 and 20, the actuator assembly 222 may include a motor 312, a guide member 314 and a slide member 316. The guide member 314 may be rotatably coupled to the aft support 228 of the base frame 212 by bracket 318. The slide member 316 may be slidable along the guide member 314 and may be rotatably coupled to the seat bottom frame 218 by brackets 320. Operation of the motor 312 in a first direction may cause the slide member 316 to move along the guide member 314 away from the motor 312, which causes the seat bottom frame 218 and the linkages 220 to move toward the extended position, which in turn, causes the seatback frame 216 to simultaneously move toward a reclined position. Operation of the motor 312 in a second direction may cause the slide member 316 to move along the guide member 314 toward the motor 312, which causes the seat bottom frame 218 and the linkages 220 to move toward the stowed position, which in turn, causes the seatback frame 216 to simultaneously move toward an upright position. Because the linkages 220 are able to simultaneously move the legrest platform 224, the seat bottom frame 218, and the seatback frame 216, the mechanism 219 only needs to incorporate a single motor (rather than one motor for legrest extension and another for seatback reclining). Therefore, a two-button controller can be implemented to control the motor 312 (e.g., one button for moving the mechanism 219 toward the extended position, and another button for moving the mechanism 219 toward the stowed position).

The configuration of the mechanism 219 described above and shown in the figures provides several benefits and advantages over conventional linkages. For example, the support track 270 and the movement of the support track 270 and seat bottom frame 218 along the rollers 248, 252 allow for further extension of the legrest platform 224 when the mechanism 219 is in the extended position while also allowing the mechanism 219 to be stowed into a more compact (i.e., "low-profile") area when the mechanism 219 is in the stowed position. This allows the furniture member 210 to provide as much or more comfort in the fully extended position as a conventional recliner, while also allowing the furniture member to have the same aesthetic appear and design cues of popular stationary furniture.

Figure 15:
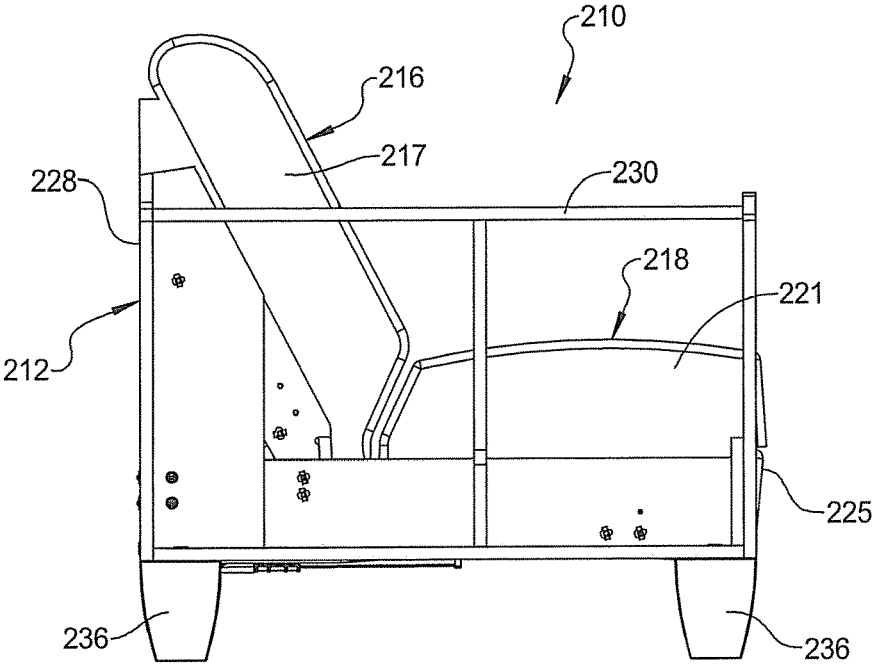
FIG. 15 is a side view of the furniture member of FIG. 14 with the recliner and legrest mechanism in the stowed position.

That is, the configuration of the mechanism 219 allows for a variety of shapes and configurations of the base frame 212 that are not found in conventional motion furniture. For example, the base frame 212 can include a high-leg configuration (e.g., with legs 236 being six inches high in some embodiments) with little or none of the mechanism 219 being visible when the mechanism 219 is in the stowed position, as shown in FIG. 15. Additionally, the furniture member 210 can have a low seat-frame-height (e.g., 11.5 inches from the floor to the top of the seat bottom frame 218 in the stowed position). This combination of high legs and low seat-frame-height leaves a very small area into which the entire mechanism 219 is packaged in the stowed position.

The additional range of motion of the linkages 220 allow the seatback frame 216 and the legrest platform 224 to be in a "zero-gravity" position when the mechanism 219 is in the fully extended position. This "zero gravity" position may be particularly comfortable for many users, as the user's feet (resting on the fully extended legrest platform 224) will be positioned at or near the vertical level (i.e., the vertical distance off of the ground) of the user's heart. This "zero-gravity" positioning of the user's body in the furniture member 210 promotes restfulness and relaxation.

It will be appreciated that the mechanism 219 could be incorporated into a single-seat chair, a motion sofa, a motion loveseat or any style or type of furniture member. Furthermore, while the mechanism 219 is described above as being powered by the motor-driven actuator assembly 222, in some configurations, the linkages 220 could be manually powered.

Referring now to FIGS. 25-28, the furniture member 10 is depicted with an upholstery 500 system covering the base frame 12, seatback frames 16 and seat bottom frames 18. The seatback frames 16 of both seat assemblies 14 can be covered by a single, unitary seatback cushion 502. Seatback upholstery 504 may be wrapped taut around at a least a portion of the seatback cushion 502. Each seat bottom frame 16 may be covered by individual seat bottom cushions 506 that are each wrapped in respective upholstery layers 508. In some configurations, the seat bottom cushions 502 may have heights (thicknesses) of about eight inches. As shown in FIGS. 25-28, each entire seat bottom cushion and upholstery 506, 508 is movable relative to the entire other seat bottom cushion and upholstery 506, 508 and relative to the seatback cushion and upholstery 502, 504 as the seatback frame 16 reclines and the mechanism 19 moves toward the extended position.

Figure 26:
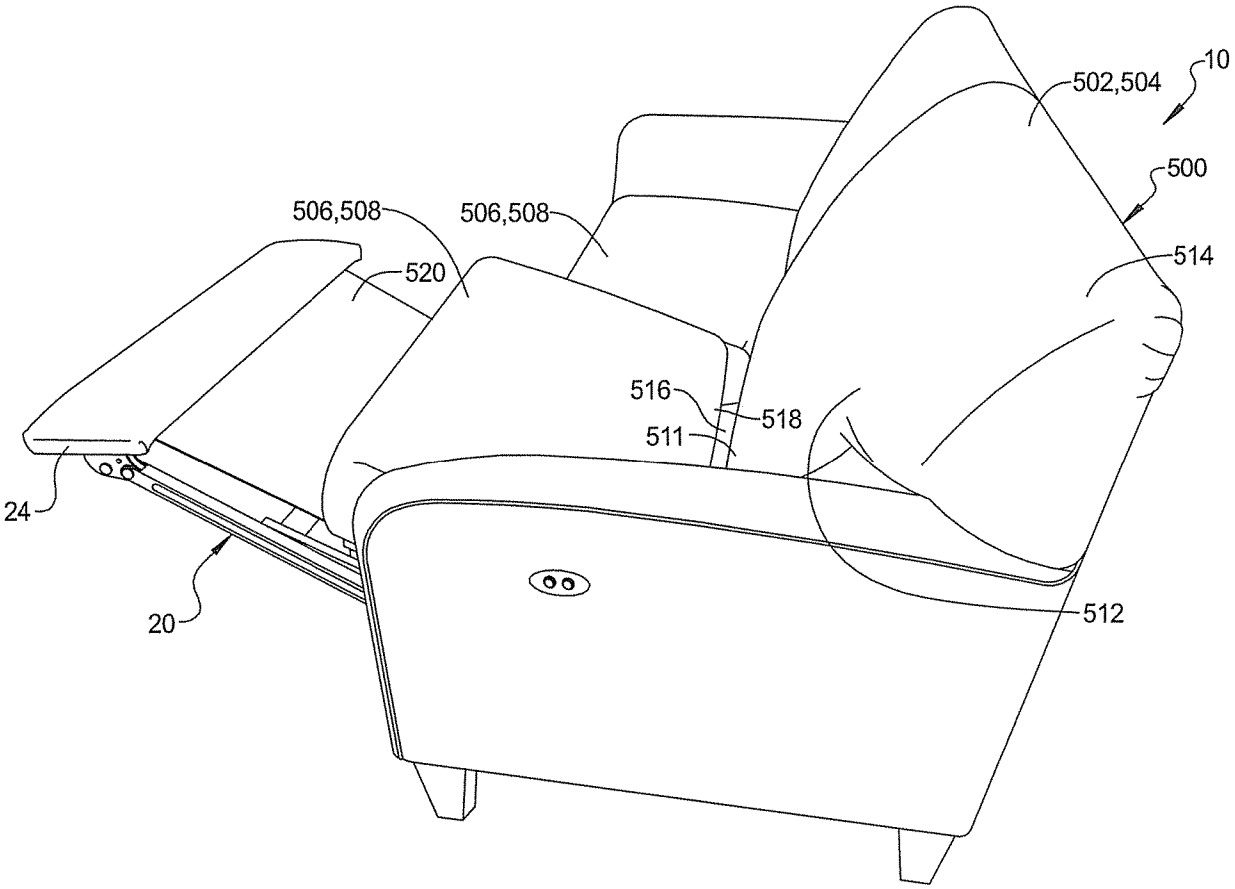
FIG. 26 is a perspective view of the furniture member of FIG. 25 in the extended position.
Figure 27:
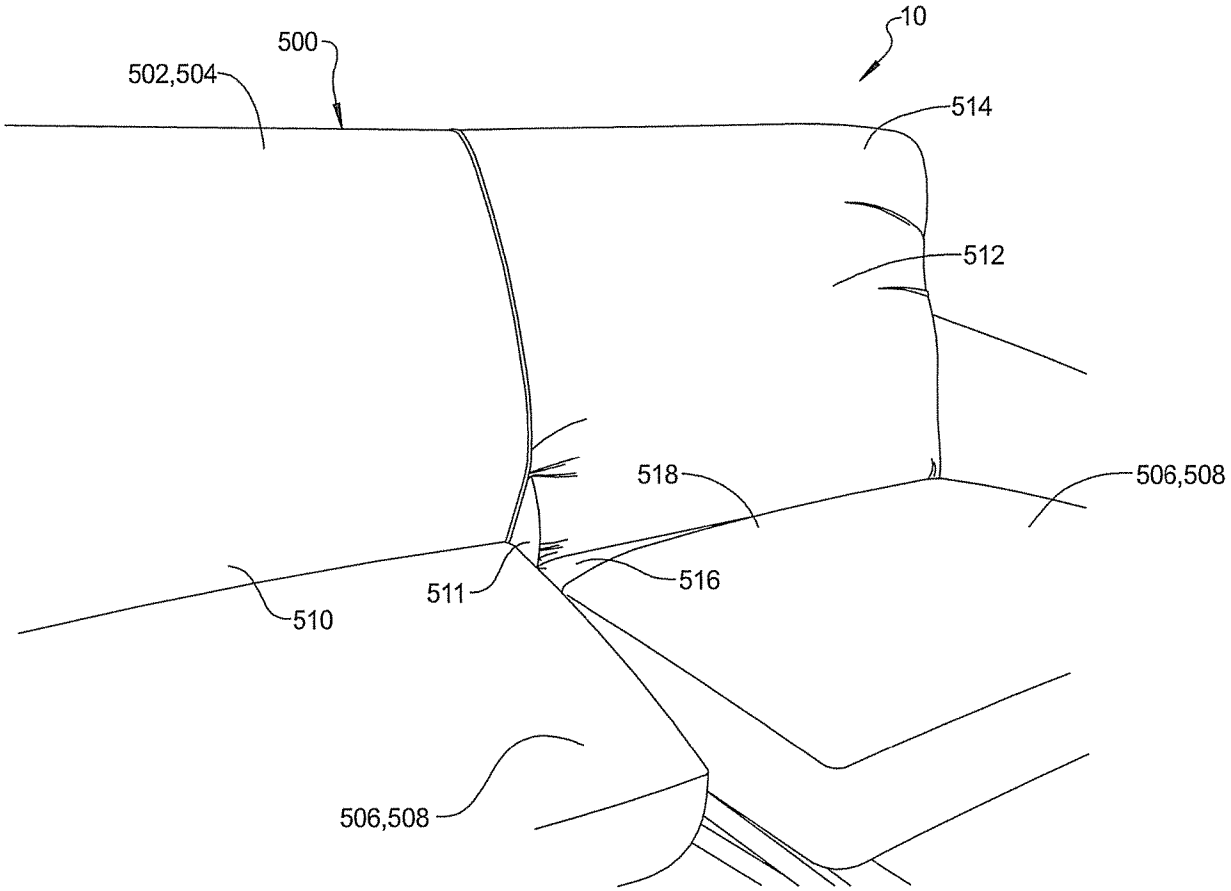
FIG. 27 is a partial perspective view of the furniture member of FIG. 25 in the extended position.
Figure 28:
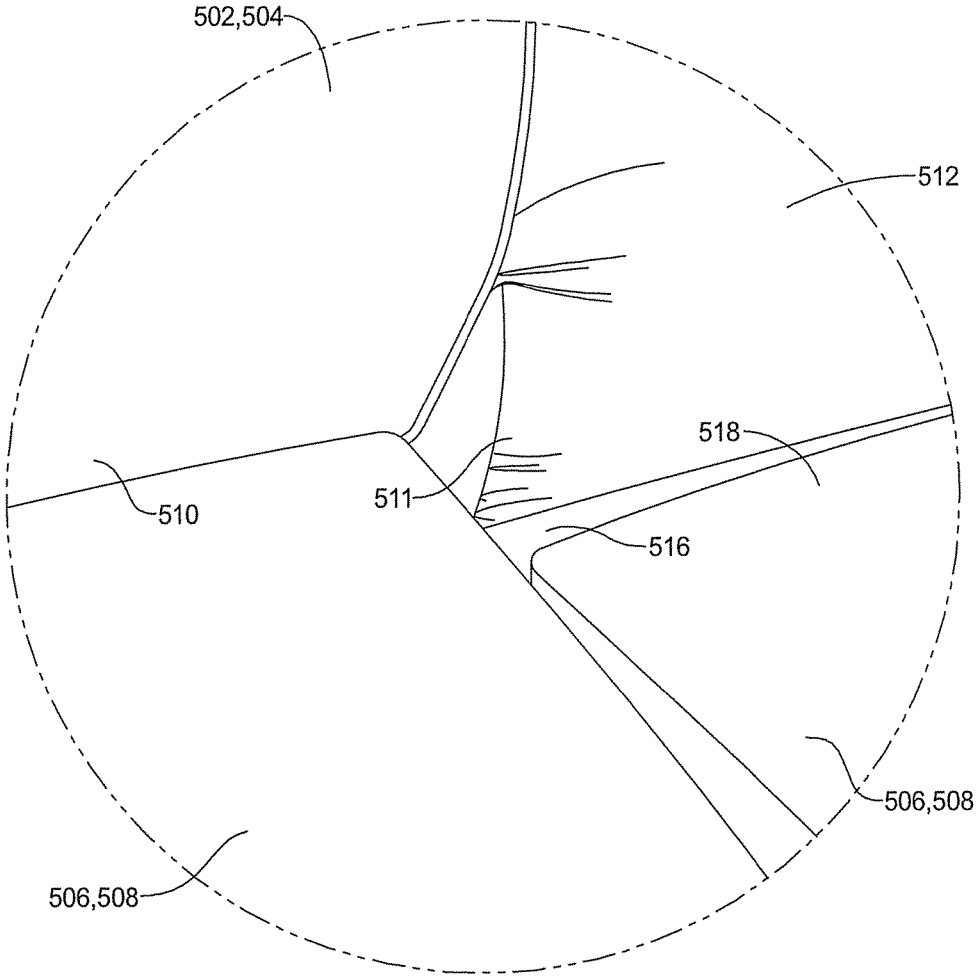
FIG. 28 is another partial perspective view of the furniture member of FIG. 25 in the extended position.

As shown in FIGS. 26-28, first and second lower portions 510, 511 of the seatback cushion and upholstery 502, 504 are independently movable relative to each other and relative to middle and upper portions 512, 514 of the seatback cushion and upholstery 502, 504 as the seatback frames 16 reclines and the mechanisms 19 move toward the extended position. As shown in FIGS. 27 and 28, one of the first and second lower portions 510, 511 can pivot forward in response to forward rotation of a lower end of the seatback frame 16 as the seatback frame 16 moves toward the reclined position.

As shown in FIGS. 26 and 28, a gap 516 is formed between an aft end 518 of the seat bottom cushion and upholstery 506, 508 and the lower portion 511 when the seatback frame 16 is in the reclined position and the mechanism 19 is in the extended position. This is due to the effective length change of the seatback frame 16 described above (i.e., L2>L1). The gap 516 may be entirely closed (i.e., the aft end 518 is in contact with the lower portion 511) when the seatback frame 16 is in the upright position and the mechanism 19 is in the stowed position.

As shown in FIG. 26, each seat assembly 14 may include an upholstery layer or sheet 520 that may at least partially cover the linkages 20 when the mechanism 19 is in the extended position. A cross member 522 (FIGS. 3 and 4) may be attached to each seat bottom frame 18 and may support the corresponding upholstery sheet 520 when the mechanism 19 is in the extended position. The upholstery sheet 520 may be folded underneath the seat bottom frame 18 when the mechanism 19 is in the stowed position.

The structure and function of the upholstery system 500 described above allows the furniture member 10 to provide as much or more comfort in the fully extended and reclined position as a conventional recliner, while also allowing the furniture member 10 to have the same aesthetic appearance and design cues of popular stationary furniture. While the upholstery system 500 is described as being incorporated into the furniture member 10 with the mechanisms 19 described above, it will be appreciated that the upholstery system 500 could be incorporated into other furniture items having different recliner and legrest mechanisms.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a stationary base frame including a forward support, an aft support, and a pair of armrests that extend between the forward support and the aft support, wherein the forward and aft supports are stationary and fixed relative to each other, and wherein the aft support is disposed vertically higher than the forward support and the armrests;

a seat bottom frame supported by the stationary base frame;

a seat bottom cushion supported by the seat bottom frame;

a seatback frame having an upper end and a lower end, the upper end pivotably coupled to the aft support such that the seatback frame is rotatable relative to the aft support and the seat bottom frame between a first position and a second position; and a seatback cushion mounted on the seatback frame, the seatback cushion including an upper end and lower end, the lower end of the seatback cushion having a greater range of motion than the upper end of the seatback cushion when the seatback frame moves between the first and second positions, wherein movement of the seatback frame between the first and second positions causes a first portion of the seatback cushion to move relative to a second portion of the seatback cushion.

2. The furniture member of claim 1, wherein the seat bottom cushion is movable with the seat bottom frame relative to the stationary base frame.

3. The furniture member of claim 2, further comprising a legrest mechanism coupled to the seat bottom frame and movable relative to the stationary base frame between a retracted position and an extended position.

4. The furniture member of claim 3, wherein the seatback frame moves between the first and second positions in response to movement of the seat bottom frame relative to the stationary base frame.

5. The furniture member of claim 4, wherein the first position of the seatback frame is an upright position and the second position of the seatback frame is a reclined position.

6. The furniture member of claim 5, wherein the seatback cushion bends as the seatback frame moves between the first and second positions.

7. The furniture member of claim 6, wherein the seatback cushion bends such that a lower portion of the seatback cushion moves forward relative to the rest of the seatback cushion as the seatback frame moves toward the second position.

8. The furniture member of claim 1, further comprising an upholstery sheet that covers the seatback cushion and is at least partially wrapped around the aft support.

9. The furniture member of claim 8, wherein at least a portion of the upholstery sheet is fixed relative to the aft support.

10. The furniture member of claim 1, wherein the upper end of the seatback frame is disposed a first distance from the seat bottom frame when the seatback frame is in the first position, and wherein the upper end of the seatback frame is disposed a second distance from the seat bottom frame when the seatback frame is in the second position, and wherein the second distance is greater than the first distance.

11. A furniture member comprising:

a stationary base frame including a forward support, an aft support, and a pair of armrests that extend between the forward support and the aft support, wherein the forward and aft supports are stationary and fixed relative to each other, and wherein the aft support is disposed vertically higher than the forward support and the armrests;

a seat bottom frame movable relative to the forward support, the aft support and the armrests; and a seatback cushion attached to the aft support, the seatback cushion bending in response to movement of the seat bottom frame.

12. The furniture member of claim 11, wherein the aft support is disposed closer to an upper portion of the seatback cushion than to a lower portion of the seatback cushion.

13. The furniture member of claim 11, further comprising a seat bottom cushion that is movable with the seat bottom frame relative to the stationary base frame.

14. The furniture member of claim 13, further comprising a legrest mechanism coupled to the seat bottom frame and movable relative to the stationary base frame between a retracted position and an extended position.

15. The furniture member of claim 11, further comprising an upholstery sheet that covers the seatback cushion and is at least partially wrapped around the aft support.

16. The furniture member of claim 15, wherein at least a portion of the upholstery sheet is fixed relative to the aft support.

17. A furniture member comprising:

a stationary base frame including a forward support, an aft support, and a pair of armrests that extend between the forward support and the aft support, wherein the forward and aft supports are stationary and fixed relative to each other, and wherein the aft support is disposed vertically higher than the forward support and the armrests;

a seat bottom frame supported by the stationary base frame;

a seatback frame including an upper end and a lower end, the lower end disposed adjacent the seat bottom frame, the upper end pivotably coupled to the aft support such that the seatback frame is rotatable relative to the aft support between a fully upright position and a fully reclined position; and a seatback cushion supported by the seatback frame wherein at least a portion of the aft support is disposed vertically higher than the entire seatback frame when the seatback frame is in the fully upright position and when the seatback frame is in the fully reclined position, and wherein movement of the seatback frame between the fully upright and fully reclined positions causes a first portion of the seatback cushion to move relative to a second portion of the seatback cushion.

18. The furniture member of claim 17, wherein the seat bottom frame is movable relative to the stationary base frame.

19. The furniture member of claim 18, further comprising a legrest mechanism coupled to the seat bottom frame and movable relative to the stationary base frame between a retracted position and an extended position.

20. The furniture member of claim 19, wherein the seatback frame moves between the fully upright and fully reclined positions in response to movement of the seat bottom frame relative to the stationary base frame.

21. The furniture member of claim 20, further comprising an upholstery sheet that covers the seatback frame and is at least partially wrapped around the aft support.

22. The furniture member of claim 21, wherein at least a portion of the upholstery sheet is fixed relative to the aft support.

23. The furniture member of claim 17, wherein the seatback cushion bends as the seatback frame moves between the fully upright and fully reclined positions, and where in the seatback cushion bends such that a lower portion of the seatback cushion moves forward relative to the rest of the seatback cushion as the seatback frame moves toward the fully reclined position.

24. The furniture member of claim 17, further comprising a seatback cushion supported by the seatback frame, wherein movement of the seatback frame between the fully upright and fully reclined positions causes a first portion of the seatback cushion to move relative to a second portion of the seatback cushion.

25. The furniture member of claim 1, wherein at least a portion of the aft support is disposed vertically higher than the entire seatback frame when the seatback frame is in the first position and when the seatback frame is in the second position.

26. The furniture member of claim 11, further comprising a seatback frame supporting the seatback cushion, wherein the seatback frame includes an upper end and a lower end, wherein the upper end is pivotably coupled to the aft support such that the seatback frame is rotatable relative to the aft support and the seat bottom frame between a first position and a second position.

27. The furniture member of claim 26, wherein at least a portion of the aft support is disposed vertically higher than the entire seatback frame when the seatback frame is in the first position and when the seatback frame is in the second position.

* * * * *